US006783210B2

(12) United States Patent
Takahashi et al.

(10) Patent No.: US 6,783,210 B2
(45) Date of Patent: Aug. 31, 2004

(54) INK JET RECORDING APPARATUS AND METHOD OF DRIVING THE SAME

(75) Inventors: Tomoaki Takahashi, Nagano (JP); Tomohiro Sayama, Nagano (JP); Goki Hiramoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 129 days.

(21) Appl. No.: 10/189,187

(22) Filed: Jul. 5, 2002

(65) Prior Publication Data

US 2003/0048331 A1 Mar. 13, 2003

(30) Foreign Application Priority Data

Jul. 5, 2001 (JP) ..... P2001-204385
Jul. 5, 2001 (JP) ..... P2001-204386

(51) Int. Cl.[7] ..... B41J 2/05; B41J 2/06
(52) U.S. Cl. ..... 347/57; 347/55
(58) Field of Search ..... 347/57, 56, 55, 347/54, 151, 120, 141, 154, 103, 123, 111, 159, 127, 128, 131, 125, 158; 399/271, 290, 292, 293, 294, 295

(56) References Cited

U.S. PATENT DOCUMENTS 6,328,395 B1 * 12/2001 Kitahara et al. ..... 347/9

FOREIGN PATENT DOCUMENTS

| | | | |
|---|---|---|---|
| JP | 59-42965 | A | 3/1984 |
| JP | 11-58729 | A | 3/1999 |
| JP | 11-300964 | A | 11/1999 |
| JP | 2000-71440 | A | 3/2000 |

* cited by examiner

*Primary Examiner*—Raquel Yvette Gordon
(74) *Attorney, Agent, or Firm*—Sughrue Mion, PLLC

(57) ABSTRACT

A recording head provided with a plurality of nozzles, a plurality of pressure chambers, each communicated with one nozzle, and a plurality of pressure generating elements, each associated with one pressure chamber and actuated to eject ink from one associated nozzle. An ejection controller specifies a nozzle from which an ink droplet having the least weight is ejected as a reference nozzle. A driving signal generator generates a driving signal applied to the respective pressure generating elements. The drive signal has a driving voltage determined such that an ink droplet ejected from the reference nozzle has a predetermined flight velocity or more.

18 Claims, 16 Drawing Sheets

Vh' = 25V

| NOZZLE ROW | 1 | 2 | 3 | 4 | 5 | 6 | 7 |
|---|---|---|---|---|---|---|---|
| FLIGHT VELOCITY (m/s) | 5.0 | 6.0 | 6.4 | 4.0 | 6.4 | 6.4 | 5.0 |

Vh = 30V

| NOZZLE ROW | 1 | 2 | 3 | 4 | 5 | 6 | 7 |
|---|---|---|---|---|---|---|---|
| FLIGHT VELOCITY (m/s) | – | – | – | 5.0 | – | – | – |

Vh = 30V

| NOZZLE ROW | 1 | 2 | 3 | 4 | 5 | 6 | 7 |
|---|---|---|---|---|---|---|---|
| INK AMOUNT (pL) | 2.00 | 2.10 | 2.14 | 1.90 | 2.14 | 2.14 | 2.00 |
| COLOR ADJUSTMENT ID | 50 | 55 | 57 | 45 | 57 | 57 | 50 |

(STANDARD VALUE: 50)

| NOZZLE ROW | 1 | 2 | 3 | 4 | 5 | 6 | 7 |
|---|---|---|---|---|---|---|---|
| COLOR ADJUSTMENT ID | 50 | 55 | 57 | 45 | 57 | 57 | 50 |
| ADJUSTED RATE (%) | 0 | -5 | -7 | +5 | -7 | -7 | 0 |
| NUMBER OF EJECTION PER UNIT AREA | 100 | 95 | 93 | 105 | 93 | 93 | 100 |

| NOZZLE ROW | 1 | 2 | 3 | 4 | 5 | 6 | 7 |
|---|---|---|---|---|---|---|---|
| COLOR ADJUSTMENT ID (2pL) | 50 | 55 | 57 | 45 | 57 | 57 | 50 |
| COLOR ADJUSTMENT ID (13pL) | 49 | 51 | 53 | 47 | 54 | 54 | 49 |

| NOZZLE ROW | 1 | 2 | 3 | 4 | 5 | 6 | 7 |
|---|---|---|---|---|---|---|---|
| COLOR ADJUSTMENT ID (2pL) | 50 | 55 | 57 | 45 | 57 | 57 | 50 |
| COLOR ADJUSTMENT ID (13pL) | 48 | 50 | 52 | 46 | 53 | 53 | 48 |

| | | Iw | |
|---|---|---|---|
| Tc RANK ID | 0 | Iw2 > Iw1 < Iw3 | |
| | | Iw2 > Iw1 = Iw3 | |
| | | Iw2 = Iw1 < Iw3 | |
| | 1 | Iw2 < Iw1 < Iw3 | |
| | 2 | Iw2 > Iw1 > Iw3 | |
| | ERROR | Iw2 = Iw1 = Iw3 | |
| | | Iw2 = Iw1 > Iw3 | |
| | | Iw2 < Iw1 = Iw3 | |
| | | Iw2 < Iw1 > Iw3 | |

HEAD A

| NOZZLE ROW | 1 | 2 | 3 | 4 | 5 | 6 | 7 |
|---|---|---|---|---|---|---|---|
| COLOR ADJUSTMENT ID | 45 | 50 | 55 | 45 | 50 | 50 | 55 |

HEAD B

| NOZZLE ROW | 1 | 2 | 3 | 4 | 5 | 6 | 7 |
|---|---|---|---|---|---|---|---|
| COLOR ADJUSTMENT ID | 35 | 40 | 55 | 60 | 50 | 50 | 60 |

FIG. 24A

| | | | | | | | | | |
|---|---|---|---|---|---|---|---|---|---|
| Tc RANK 1 | HEAD A | NOZZLE ROW | 1 | 2 | 3 | 4 | 5 | 6 | 7 |
| | | COLOR ADJUSTMENT ID | 45 | 50 | 55 | 45 | 50 | 50 | 55 |
| | | OFFSET ID: 0, Vh: 2.0pL (Vh') | | | | | | | |
| | HEAD B | NOZZLE ROW | 1 | 2 | 3 | 4 | 5 | 6 | 7 |
| | | COLOR ADJUSTMENT ID | 35 | 40 | 55 | 60 | 50 | 50 | 60 |
| | | OFFSET ID: 0, Vh: 2.0pL (Vh') | | | | | | | |

FIG. 24B

| | | | | | | | | | |
|---|---|---|---|---|---|---|---|---|---|
| Tc RANK 0 | HEAD A | NOZZLE ROW | 1 | 2 | 3 | 4 | 5 | 6 | 7 |
| | | COLOR ADJUSTMENT ID | 45 | 50 | 55 | 45 | 50 | 50 | 55 |
| | | OFFSET ID: 0, Vh: 2.0pL (Vh') | | | | | | | |
| | HEAD B | NOZZLE ROW | 1 | 2 | 3 | 4 | 5 | 6 | 7 |
| | | COLOR ADJUSTMENT ID | 35 | 40 | 55 | 60 | 50 | 50 | 60 |
| | | OFFSET ID: 5, Vh: 2.1pL | | | | | | | |

FIG. 24C

| | | | | | | | | | |
|---|---|---|---|---|---|---|---|---|---|
| Tc RANK 2 | HEAD A | NOZZLE ROW | 1 | 2 | 3 | 4 | 5 | 6 | 7 |
| | | COLOR ADJUSTMENT ID | 45 | 50 | 55 | 45 | 50 | 50 | 55 |
| | | OFFSET ID: 5, Vh: 2.1pL | | | | | | | |
| | HEAD B | NOZZLE ROW | 1 | 2 | 3 | 4 | 5 | 6 | 7 |
| | | COLOR ADJUSTMENT ID | 35 | 40 | 55 | 60 | 50 | 50 | 60 |
| | | OFFSET ID: 15, Vh: 2.3pL | | | | | | | |

FIG. 25A

Tc RANK: 0, HEAD A

| NOZZLE ROW | 1 | 2 | 3 | 4 | 5 | 6 | 7 |
|---|---|---|---|---|---|---|---|
| COLOR ADJUSTMENT ID | 45 | 50 | 55 | 45 | 50 | 50 | 55 |
| ADJUSTED RATE (%) | +5 | 0 | -5 | +5 | 0 | 0 | -5 |
| NUMBER OF EJECTION PER UNIT AREA | 105 | 100 | 95 | 105 | 100 | 100 | 95 |

FIG. 25B

Tc RANK: 2, HEAD B

| NOZZLE ROW | 1 | 2 | 3 | 4 | 5 | 6 | 7 |
|---|---|---|---|---|---|---|---|
| COLOR ADJUSTMENT ID + OFFSET ID | 50 | 55 | 70 | 75 | 65 | 65 | 75 |
| ADJUSTED RATE (%) | 0 | -5 | -20 | -25 | -15 | -15 | -25 |
| NUMBER OF EJECTION PER UNIT AREA | 100 | 95 | 83 | 80 | 87 | 87 | 80 |

FIG. 26

| NOZZLE ROW | 1 | 2 | 3 | 4 | 5 | 6 | 7 |
|---|---|---|---|---|---|---|---|
| HIGH-SPEED MODE (13pL) | 45 | 50 | 53 | 55 | 50 | 50 | 55 |
| HIGH-RESOLUTION MODE (2pL) | 50 | 55 | 70 | 75 | 65 | 65 | 75 |

INK JET RECORDING APPARATUS AND METHOD OF DRIVING THE SAME

BACKGROUND OF THE INVENTION

The present invention relates to an ink jet recording apparatus, such as a printer or a plotter, and a method of driving the same, and more particularly, to an ink jet recording apparatus having a recording head including a plurality of nozzle rows.

Some of ink jet recording apparatus (hereinafter simply called "recording apparatus"), such as some printers or plotters, have a recording head including a plurality of nozzle rows for effecting color recording, high-speed recording, or the like recording operation.

In the recording head, the amount of ink to be ejected varies when a drive voltage of a drive signal is increased or decreased, whereby the density of an image deviates from designed standard density. For this reason, setting of an optimal drive voltage is important. To this end, the amount of ink has conventionally been determined for each nozzle row, and a drive voltage of a drive signal has conventionally been determined such that an average calculated from the thus-determined amount of ink assumes a target amount.

For instance, in a case where an ink droplet of 8.0 pL (picoliters, the same also applies in the following description), which is a target amount, is ejected through use of a recording head having a total number of seven nozzle rows, the amount of ink a1 is taken for the first nozzle row; the amount of ink a2 is taken for the second nozzle row; . . . , and the amount of ink a7 is taken for the seventh nozzle row. A drive voltage is set such that a value resulting from division of the sum of the amounts of ink a1 to a7 by 7 assumes a value of 8.0 pL.

Since the amount of ink ejected from the recording head tends to vary from one nozzle row to another nozzle row, identifying information indicating a variation in the amount of ink is imparted to respective nozzle rows.

A drive signal of the thus-set drive voltage is supplied to pressure generating elements (e.g., piezoelectric transducers) of the recording head, thereby causing the elements to eject ink droplets. Further, the number of times ink droplets are ejected per unit area is increased or decreased by reference to the identifying information. Thus, an image whose image density and color balance have been adjusted is recorded.

Recently, strong demand has arisen for a recording apparatus of this type which produces a higher image quality. Further, the amount of ink has also reduced considerably to, e.g., 4 to 2 pL. In the case of such ink droplets of smaller amount, a difference in velocity of ink droplets between nozzle rows becomes greater than in the case of a related-art recording apparatus. When the above-stated adjustment method was applied to such a related-art recording apparatus, some ink droplets were found to fly at a velocity lower than the minimum required velocity.

A deficiency in flight velocity often results in deviation of an ink droplet from a regular landing position. This is considered to be attributable to the following. Namely, the recording apparatus is configured to eject ink droplets while a recording head is moved in a main scanning direction, and the trajectory of ink droplets having flown deviates from a normal trajectory for reasons of a deficiency in flight velocity.

It has turned out that a deviation in the landing position induces degradation of image quality, such as appearance of graininess in a recorded image or occurrence of a curvature of a line. Further, ink droplets have also been found to turn into mist before arrival at a print recording medium.

In the case of the small amount of ink, a variation arising in amount of ink between nozzle rows also becomes large. However, if the variation in the amount of ink has exceeded an allowable range, ink ejected from a nozzle row, which eject a smaller amount of ink, is found to fail to fill a portion in a solid painted image, thereby causing a white streak.

SUMMARY OF THE INVENTION

The invention has been conceived in light of the circumstances and aims at improving a recorded image quality by use of a small amount of ink.

In order to achieve the above object, according to the present invention, there is provided an ink jet recording apparatus, comprising:

- a recording head provided with:
  - a plurality of nozzles;
  - a plurality of pressure chambers, each communicated with one nozzle; and
  - a plurality of pressure generating elements, each associated with one pressure chamber and actuated to eject ink from one associated nozzle;
- an ejection controller, which specifies a nozzle from which an ink droplet having the least weight is ejected as a reference nozzle; and
- a driving signal generator, which generates a driving signal applied to the respective pressure generating elements, the drive signal having a driving voltage determined such that an ink droplet ejected from the reference nozzle has a predetermined flight velocity or more.

Preferably, the ejection controller specifies a nozzle from which an ink droplet having the lowest flight velocity is ejected as the reference nozzle.

With such configurations, the flight velocities of ink droplets ejected from nozzles which provide the lowest flight velocity become not less than a required velocity. Therefore, even when an extremely small amount of ink is ejected, the ink can be impacted on a predetermined position without fail, thereby preventing transformation of ink into mist. Ink droplets ejected from the remaining nozzles have flight velocities at least equal to or greater than that provided by the reference nozzles, and hence the accuracy of landing position can be ensured, thereby preventing transformation of ink into mist.

Since a high correlation exists between the flight velocities of ink droplets and the amount of ink ejected, the flight velocities of ink drop lets become not less than the required velocity, thereby ensuring a required amount of ink. Consequently, there can be prevented occurrence of a white streak, which would otherwise be caused by a deficiency in the amount of ink.

Alternatively, it is preferable that the ejection controller specifies a nozzle from which an ink droplet having the lowest amount is ejected as the reference nozzle.

In this case, the flight velocities of ink droplets are determined on the basis of the amount of ink ejected. Hence, in addition to the foregoing advantages, the invention can simplify a measurement device and procedures and hence is suitable for mass production.

Preferably, the recording head is provided with a first identifier which indicates an ink amount ejected from each nozzle when the driving signal is applied.

Here, it is preferable that the ejection controller includes an image density corrector which determines a number of ink ejection per a unit area of each nozzle in accordance with the first identifier.

With such configurations, the hue of a recorded image can be made equal to a designed hue while the accuracy of landing position of an ink droplet is ensured. Further, the density of the image can be made equal to designed density.

Here, it is preferable that the ink jet recording apparatus further comprises a mode selector which selects one recording mode among a plurality recording modes, each defined by an ejectable minimum amount of an ink droplet. The recording head is provided with a plurality of first identifiers each indicating an ink amount ejected from each nozzle in an associated recording mode, when the driving signal is applied. The image density corrector determines the ink ejection number based on a first identifier associated with a recording mode selected by the mode selector.

Here, it is preferable that the image density corrector determines the ink ejection number only when a recording mode in which the ejectable minimum ink drop amount is less than a predetermined amount is selected by the mode selector.

With such configurations, an identifier suitable for the subject recording mode can be used, so that the image quality can be further improved.

Preferably, the recording head is provided with a second identifier which indicates a difference between a target ink ejection amount and an ink amount ejected from each nozzle when the driving signal is applied.

Here, it is preferable that the ejection controller includes an image density corrector which determines a number of ink ejection per a unit area of each nozzle in accordance with the first identifier and the second identifier.

With such configurations, the hue of a recorded image can be made equal to a designed hue while the accuracy of landing position of an ink droplet is ensured. Further, the density of the image can be made equal to designed density.

Preferably, the recording head is provided with a Tc rank which is determined with reference to a natural period of ink in the pressure chamber, and referred to determine the driving voltage.

With this configuration, a setting properly reflecting a characteristic of the recording head can be performed in accordance with a flight velocity of an ink droplet which varies in response to the natural period.

Preferably, the ink jet recording apparatus further comprises a mode selector which selects one recording mode among a plurality recording modes, each defined by an ejectable minimum amount of an ink droplet. The recording head is provided with a plurality of first identifiers each indicating an ink amount ejected from each nozzle in an associated recording mode, when the driving signal is applied. The recording head is provided with a plurality of second identifiers each indicating a difference between a target ink ejection amount and an ink amount ejected from each nozzle in an associated recording mode, when the driving signal is applied. The image density corrector determines the ink ejection number based on a first identifier and a second identifier associated with a recording mode selected by the mode selector.

Such a configuration enables use of an identifier suitable for the recording mode, thus improving an image quality to a more extent.

Preferably, the recording head is provided with a plurality of nozzle rows. The pressure generating elements are unitized with respect to each nozzle row.

Preferably, the pressure generating elements are piezoelectric vibrators.

Preferably, the recording head is provided with a plurality of nozzle rows each associated with one color. The ejection controller specifies a nozzle rows from which ink droplets having the least weight are ejected as a reference nozzle rows. The driving voltage is determined such that each ink droplet ejected from the reference nozzle row has the predetermined flight velocity.

According to the present invention, there is also provided a method of driving an ink jet recording apparatus, comprising the steps of:

providing a recording head provided with:
- a plurality of nozzles; and
- a plurality of pressure generating elements, each associated with one nozzle and actuated to eject ink therefrom;

measuring weights of the respective ink droplets ejected from the recording head;

specifying a nozzle from which an ink droplet having the least weight is ejected as a reference nozzle;

generating a drive signal having a driving voltage determined such an extent that an ink droplet ejected from the reference nozzle has a predetermined flight velocity or more.

Preferably, the reference nozzle is specified as a nozzle from which an ink droplet having the lowest flight velocity is ejected.

Alternatively, it is preferable that the reference nozzle is specified as a nozzle from which an ink droplet having the lowest amount is ejected.

Preferably, the driving method further comprises the step of determining a number of ink ejection per a unit area of each nozzle in accordance with an ink amount ejected from each nozzle when the driving signal is applied.

BRIEF DESCRIPTION OF THE DRAWINGS

In the accompanying drawings:

FIGS. 24A through 24C are views showing set color adjustment IDs and offset IDs on a per-Tc-rank basis;

FIGS. 25A and 25B are views for describing control of the number of times ink is ejected per unit area; and FIG. 26 is a view for describing a case where a plurality of recording modes are available.

DETAILED DESCRIPTION OF THE PREFERRED EMBODIMENTS

Figure 1:
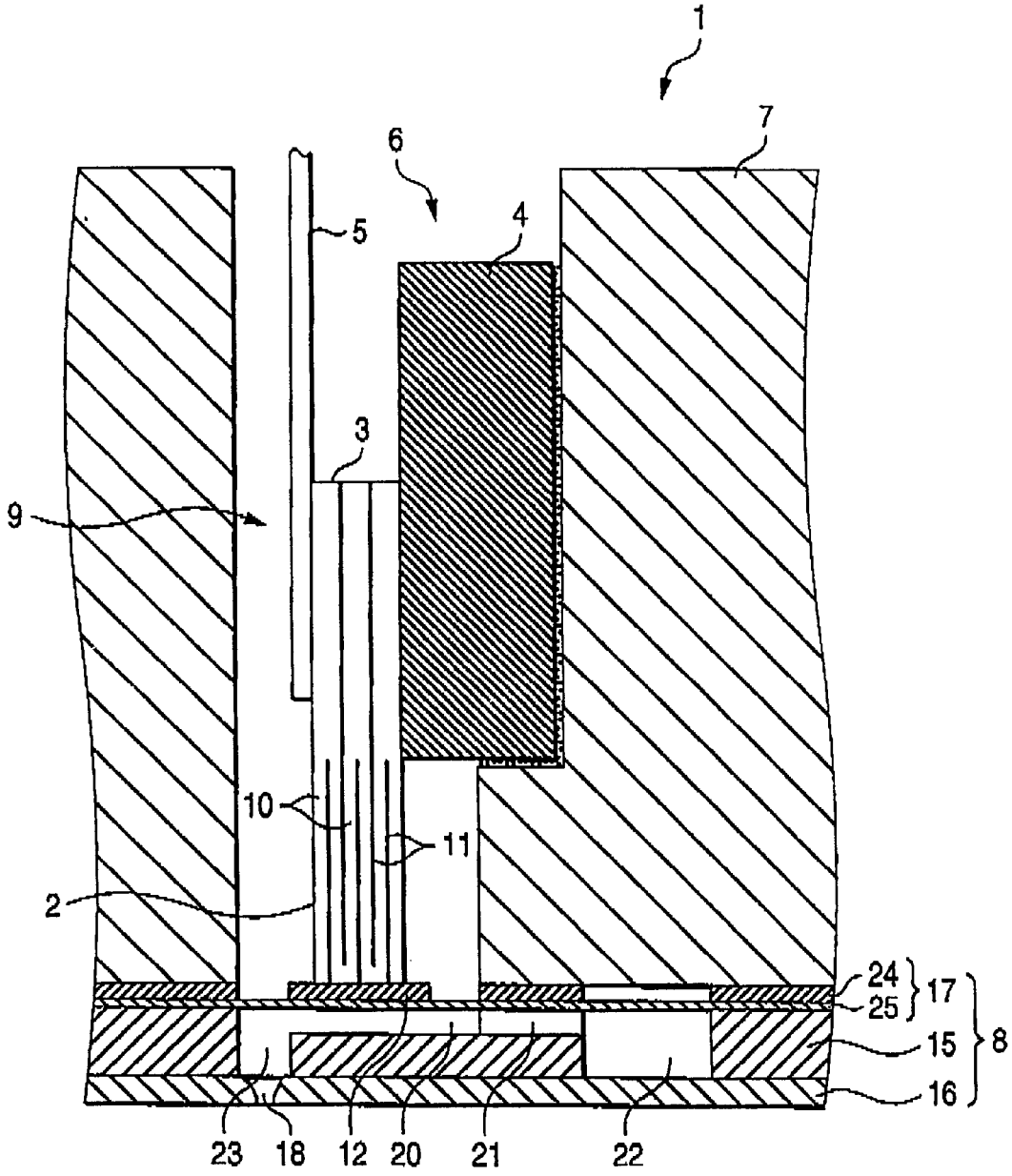
FIG. 1 is a cross-sectional view showing a portion of a recording head.
Figure 2:
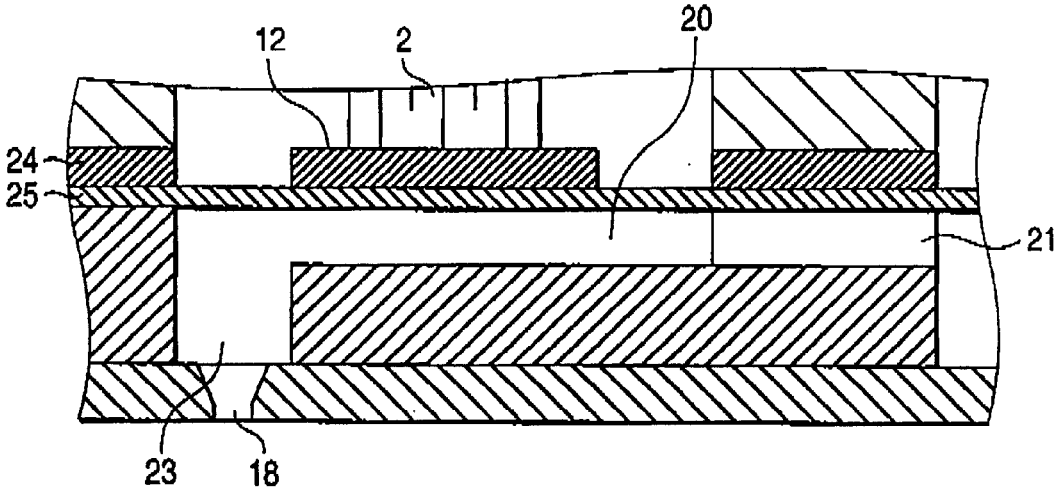
FIG. 2 is an enlarged fragmentary cross-sectional view for describing the structure of an ink channel unit.

A first embodiment of the invention will be described hereinbelow by reference to the accompanying drawings. First, the structure of an ink jet recording head (hereinafter simply referred to as a "recording head") will be described. As shown in FIG. 1, an illustrated recording head 1 comprises a vibrator assembly 3 consisting of a plurality of piezoelectric vibrators 2; a fixing plate 4; a vibrator unit 6 in which the vibrator assembly 3, the fixing plate 4, a flexible cable 5 or the like are integrated; a case 7 capable of housing the vibrator unit 6; and a channel unit 8 to be attached to a leading-end face of the case 7.

The case 7 is a block-shaped member made of synthetic resin so as to have a chamber 9 penetrating the case 7. The vibrator unit 6 is fixedly housed in the chamber 9. Specifically, the fixing plate 4 of the vibrator unit 6 is bonded to a wall face of the chamber 9 while pectinated extremities (i.e., leading-end face sections) of the piezoelectric vibrators 2 are directed to face a leading-end-side opening.

The piezoelectric vibrator 2 serves as a pressure generating element and pectinated in the longitudinal direction thereof. For instance, each tooth has an extremely narrow width of the order of 30 $\mu$m to 100 $\mu$m. The piezoelectric vibrator 2 is a piezoelectric vibrator of multilayer type constituted by alternately laminating piezoelectric elements 10 and internal electrodes 11. The piezoelectric vibrator 2 is of longitudinal vibration mode and can extend and contract in the longitudinal direction orthogonal to the direction of an electric field (i.e., the vibrator can vibrate in the longitudinal direction). Each of the piezoelectric vibrators 2 is mounted in a cantilever fashion such that a base-end portion of the piezoelectric vibrator 2 is joined to the fixing plate 4 and such that a free-end portion of the piezoelectric vibrator 2 is projected to the outside beyond the edge of the fixing plate 4.

The vibrator assembly 3 is manufactured by bonding a piezoelectric plate to the fixing plate 4, the plate being made by alternately laminating a piezoelectric element layer and an internal electrode layer, and pectinating the piezoelectric plate by use of a cutter such as a wire saw. In this way, the vibrator assembly 3 is formed from a single piezoelectric plate into a unit by cutting. Hence, deformation characteristics of the respective piezoelectric vibrators 2 can be made uniform to a good extent.

The leading-end face section of each piezoelectric vibrator 2 remains fixedly in contact with an island section 12 which is in a predetermined region of the channel unit 8. The flexible cable 5 is electrically connected to the respective piezoelectric vibrators 2 by way of a base-end side face of the vibrator assembly 3 opposite the side face thereof attached to the fixing plate 4.

The channel unit 8 is constituted by placing a nozzle plate 16 on one side of a channel forming substrate 15, and an elastic plate 17 on the other side of the same.

Figure 3:
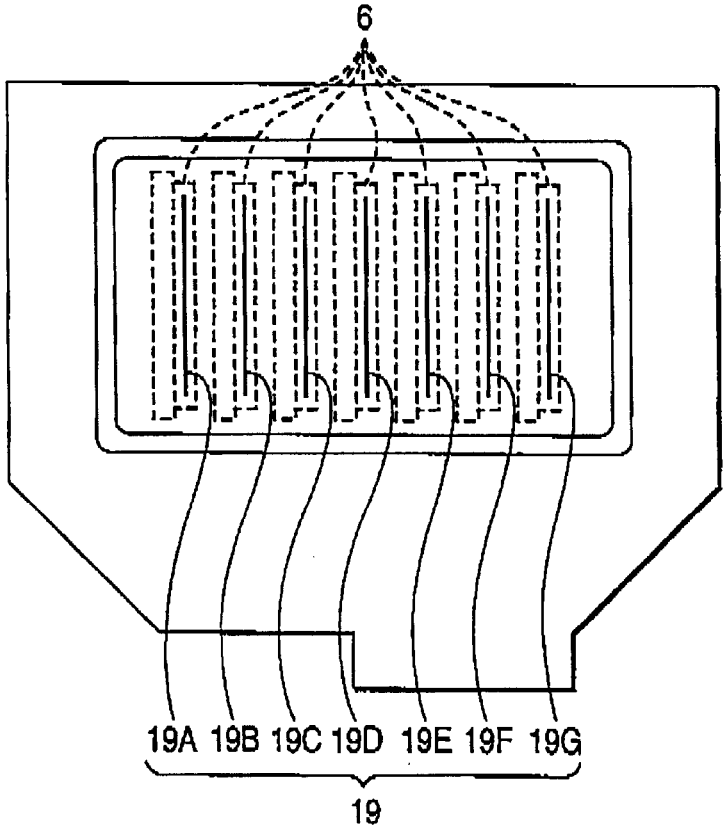
FIG. 3 is a view of the recording head when viewed from a nozzle plate.

The nozzle plate 16 is a thin plate made of stainless steel, and a plurality of nozzle orifices 18 are formed in the plate at a pitch corresponding to a density into which a dot is to be formed (hereinafter called a "dot formation density") in the form of a row. In the embodiment, the nozzle orifices 18 constitute nozzle rows 19, each including 96 nozzle orifices arranged at a pitch of 180 dpi. As shown in FIG. 3, a plurality of nozzle rows 19 are formed so as to correspond to types (e.g., colors) of ink to be ejected.

In the embodiment, a total of seven nozzle rows 19; that is, a first nozzle row 19A located at the leftmost end to a seventh nozzle row 19G located at the rightmost end, are formed side by side, and the respective nozzle rows can eject different colors of ink.

For example, the first nozzle row 19A are formed so as to be able to eject dark yellow ink; the second nozzle row 19B are formed so as to be able to eject black ink; the third nozzle row 19C are formed so as to be able to eject cyan ink; the fourth nozzle row 19D are formed so as to be able to eject light cyan ink; the fifth nozzle row 19E are formed so as to be able to eject magenta ink; the sixth nozzle row 19F are formed so as to be able to eject light magenta ink; and the seventh nozzle row 19G are formed so as to be able to eject yellow ink.

In the embodiment, the vibration unit 6 is provided for each of the nozzle rows 19A through 19G. In short, the recording head 1 has seven piezoelectric vibration units 6.

The channel forming substrate 15 is a plate-like member in which spaces to be pressure chambers 20 are formed so as to correspond to each of the nozzle orifices 18 of the nozzle plate 16. Further, other spaces to be ink supply ports 21 and common ink reservoirs 22 are also formed therein. The channel forming substrate 15 is formed by processing, e.g., a silicon wafer, through etching.

The pressure chamber 20 is a chamber which is elongated in the direction orthogonal to the direction in which the rows of nozzle orifices 18 are arranged (hereinafter the direction in which the rows of nozzle orifices are arranged is called a "nozzle row direction"). The pressure chamber 20 is constituted of a flat concave chamber defined by partitions. By the partitions, the ink supply port 21 is formed having a narrower width than the pressure chamber 20. At the position in the pressure chamber 20 most distant from the common ink chamber 22, a nozzle communication port 23 for establishing communication between the nozzle orifice 18 and the pressure chamber 20 is formed so as to penetrate through the plate.

The elastic plate 17 serves also as a diaphragm section for sealing one opening face of the pressure chamber 20 and as a compliance section for sealing one opening face of the common ink chamber 22. The elastic plate 17 assumes a dual structure formed by laminating a resin film 25, such as PPS (polyphenylenesulfide), on a support plate 24 made of stainless steel. A portion of the support plate 24 which is to act as a diaphragm section; that is, a portion of the support plate 24 corresponding to the pressure chamber 20, is annularly etched, thereby constituting the island section 12 with which the leading-end face of the piezoelectric vibrator 2 is to be fixedly in contact. Further, another portion of the support plate 24 which is to act as a compliance section; that is, a portion of the support plate 24 corresponding to the common ink reservoir 22, is removed through etching, thereby leaving only the resin film 25.

In the recording head 1 having the foregoing construction, the piezoelectric vibrators 2 are expanded in the longitudinal direction thereof (i.e., the longitudinal direction of the recording head) by electric discharge. As a result, the island sections 12 are pressed against the corresponding nozzle plates 16, whereby the resin films 25, constituting the diaphragm sections, become deformed, to thereby causing the pressure chambers 20 to contract. Further, when the piezoelectric vibrators 20 are caused to contract in the longitudinal direction thereof by a charging operation, the pressure chambers 20 expand by virtue of elastic characteristics of the resin films 25. The pressure of the ink stored in the pressure chambers 20 is changed by controlling deformation of the pressure chambers 20, whereby ink droplets are ejected from the nozzle orifices 18.

Here, variations develop in an ink ejection characteristic (i.e., the amount of ink and the flight velocity of the same) of the recording head 1 in accordance with the dimensional precision and assembly precision of components. In other words, even when ink droplets are ejected under identical conditions, ink ejection characteristics may change from one recording head 1 to another recording head 1. In particularly, when respective nozzle rows 19 have different vibrator units 6 as described in connection with the embodiment, the recording head 1 is susceptible to the influence of characteristic differences (i.e., individual differences) between the vibration units 6. Hence, the ink ejection characteristics tend to vary from one nozzle row 19 to another nozzle row 19.

In order to diminish such variations in the ink ejection characteristics, an improvement in the dimensional and assembly precision of components is conceivable. However, individual sections of the recording head 1 assume very micro geometries, and hence an improvement in the dimensional and assembly precision of components is not a realistic measure for reducing variations.

For this reason, according to the invention, the nozzle row 19 which ejects ink droplets at the lowest flight velocity is taken as a reference nozzle row, and the drive voltage of the drive signal is set such that ink droplets are ejected from the reference nozzle row at a flight velocity not less than a required velocity.

The required velocity varies in accordance with the amount of ink and a flight distance thereof. In the embodiment, provided that the amount of ink is 2.0 pL and the flight distance; that is, a distance from a nozzle face (i.e., an exterior face of the nozzle plate 16, the same also applies in the following description) to the face of recording paper, is 1.3 mm, the required velocity is set to 5.0 m/s.

As a result, a required flight velocity is ensured for an ink droplet to be ejected from the reference nozzle row. Even an extremely small amount of ink; that is, about 2 pL, can be caused to impact against a predetermined position without fail, thereby preventing transformation of ink into mist. The flight velocities of ink droplets ejected from the nozzle rows other than the reference nozzle row 19 also reach or exceed the flight velocity achieved by the reference nozzle row. In the entire recording head 1, the flight velocities of ink droplets reach or exceed the required velocity. As a result, accuracy of landing positions of ink droplets can be ensured, thereby preventing transformation of ink into mist.

The drive voltage is set in accordance with the reference nozzle row that ejects the lowest amount of ink. In contrast, the drive voltage is set for each recording head 1, and hence a change arises in the amount of ink ejected (i.e. an average amount of ink).

The change in the amount of ink ejected is attributable to occurrence of inconsistencies in the density of an image. For instance, when two recording heads 1 differ from each other in terms of the amount of ink ejected, an image recorded by the recording head 1 that ejects a greater amount of ink becomes more dense than that recorded by the recording head 1 that ejects a smaller amount of ink. Accordingly, if identical single print data are recorded by use of these recording heads, inconsistencies will arise in the density of resultant images.

As mentioned above, even in the single recording head 1, ink ejection characteristics may vary from one nozzle row 19 to another nozzle row 19. For this reason, when the recording head is actuated with a single waveform, the amount of ink ejected also varies from one nozzle row 19 to another nozzle row 19.

Changes in the amount of ink ejected between the nozzle rows 19 affect the hue of an image. Specifically, when recording operation is performed while conditions of the nozzle rows 19 are made uniform, the color of ink droplets ejected from the nozzle row 19 in the recording head 1, which nozzles eject ink in amount greater than an average amount of ink, become more dense. In contrast, the color of ink droplets ejected from the nozzle row 19, which eject ink in amount smaller than an average amount of ink, become less dense. For example, if the amount of ink ejected from the row of magenta nozzles is greater than an average amount, a resultantly-recorded image assumes a color that is more reddish than that of a standard image.

In order to compensate for a difference between the ejection characteristics of the recording heads 1 attributable to different drive voltages and a difference between the ejection characteristics of the nozzle rows 19, color adjustment IDs (first identifier) are imparted to the recording head 1. In the embodiment, the respective color adjustment IDs indicate the amounts of ink ejected from the corresponding nozzle rows 19 in accordance with a preset drive voltage of a drive signal.

When the recording head 1 is incorporated into a printer, the head realizes an image density and a hue (color balance) as designed, by increasing or decreasing the amount of ink ejected per unit area; that is, the number of times ink droplets are ejected, through use of the color adjustment IDs.

Figure 4:
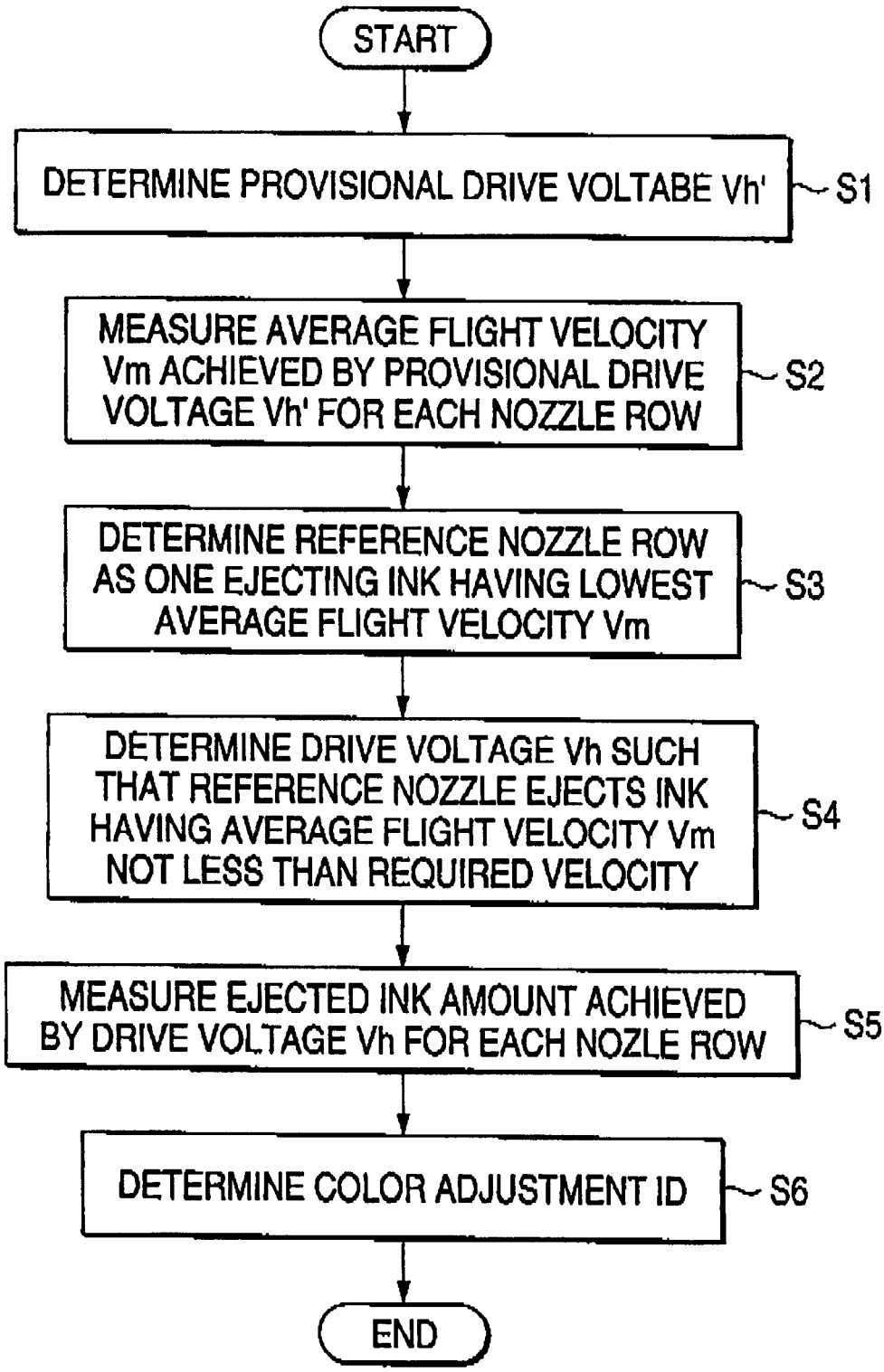
FIG. 4 is a flowchart for describing procedures for setting a drive voltage and a color adjustment ID.

Procedures for setting the drive voltage of the drive signal and color adjustment IDs will be described in detail hereinbelow, by reference to the flowchart shown in FIG. 4. The drive voltage and the color adjustment IDs are set in, e.g., the process of inspecting the recording head 1 that has finished being assembled.

A provisional drive voltage Vh' of the recording head 1 is set before setting of the voltage and the IDs (S1).

Figure 5A:
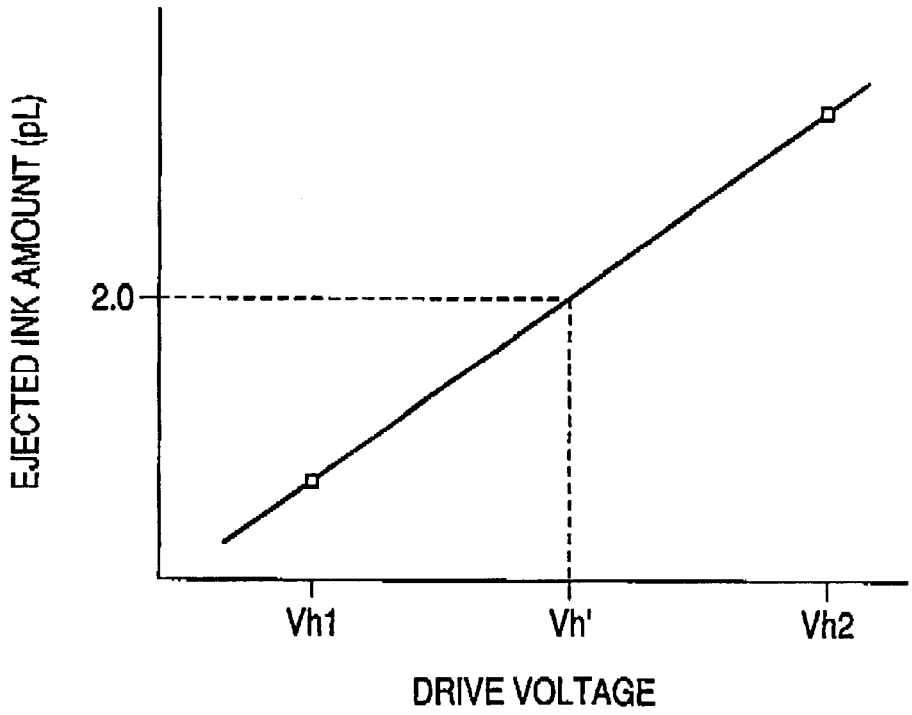
FIG. 5A is a view for describing a calibration curve to be used for determining the drive voltage.
Figure 5B:
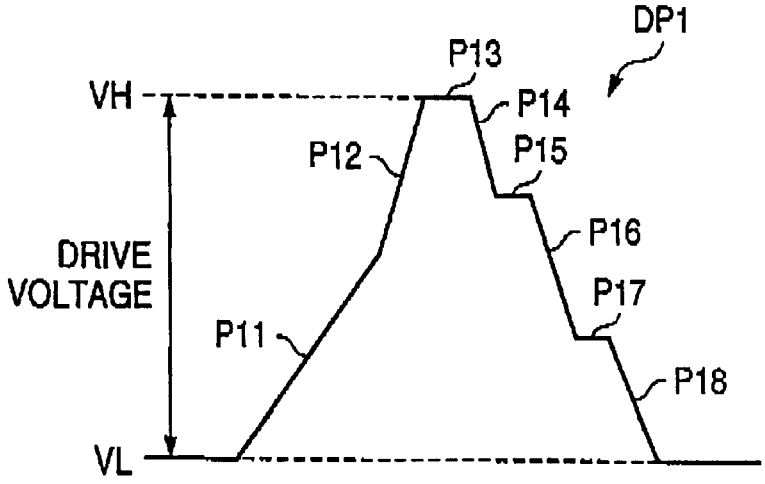
FIG. 5B is a view for describing a small dot drive pulse.

In the embodiment, the drive voltage of the drive signal corresponds to a potential difference between the maximum voltage VH and the minimum voltage VL of a small dot drive pulse DP1 shown in FIG. 5B Here, the provisional drive voltage Vh' is set such that the amount of ink ejected as a result of supply of the small dot drive pulse DP1 to the piezoelectric vibrator 2; more specifically, an average amount of ink ejected per recording head (the amount of one droplet), assumes a target value of 2.0 pL.

Here, the small dot drive pulse DP1 will be briefly described. The small dot drive pulse DP1 is constituted as a series of signals, by sequentially connecting a first charging element P11, a second charging element P12, a first holding element P13, a first discharging element P14, a second holding element P15, a second discharging element P16, a third holding element P17, and a third discharging element P18.

The pressure chamber 20 is slowly expanded to such an extent that a meniscus (a free surface of ink exposed from the nozzle orifice 18) is not vibrated excessively, by supplying the first charging element P11 to the piezoelectric vibrator 2. Subsequently, a second charging element P12 is supplied so as to rapidly expand the pressure chamber 20 to the maximum volume thereof, and the center portion of the meniscus is locally drawn into the pressure chamber 20. Next, the expanded state of the pressure chamber 20 is maintained by supply of the first holding element P13. In reaction to the drawing of the center portion, the center portion of the meniscus is raised in a convex shape in the direction of ejection. Subsequently, the first discharging element P14 is supplied, to thereby cause the pressure chamber 20 to rapidly contract and push an ink pillar to the direction of ejection. Subsequently, the second holding element P15, the second discharging element P16, the third holding element P17, and the third discharging element P18 are sequentially supplied, to thereby cause the pressure chamber 20 to constrict in a stepwise manner. Consequently, the extremity of the ink pillar is torn from the main body and flies toward the direction of ejection. Thus, an ink droplet having an extremely small amount of ink, about 2.0 pL, is ejected from the nozzle orifice 18.

In relation to the small dot drive pulse DP1, the amount of ink ejected in accordance with a drive voltage changes. Therefore, as shown in FIG. 5A, at the time of setting of a provisional drive voltage Vh', a calibration curve is prepared through use of a minimum voltage Vh1 in a range in which ink droplets are ejectable, the amount of ink corresponding to the minimum voltage Vh1, a maximum voltage Vh2 in the range, and the amount of ink corresponding to the maximum voltage Vh2. A provisional drive voltage Vh' is set through use of the calibration curve. More specifically, from the thus-prepared calibration curve, a voltage corresponding to a target value of 2.0 pL is determined. The thus-acquired voltage is taken as a provisional drive voltage Vh'.

The amount of ink ejected per recording head 1; more specifically, an average amount of ink ejected from all nozzle orifices 18, is used for the amount of ink to be used for preparing the calibration curve. The average amount of ink is calculated by measuring the amount of ink captured by use of, e.g., an electronic force balance (not shown), and dividing the amount of thus captured ink by the number of times ink is ejected and the total number of nozzle orifices 18.

If the provisional drive voltage Vh' has been set, the flight velocity (an average velocity Vm) of ink droplets ejected at the provisional drive voltage Vh' is measured for each nozzle row 19 (S2).

Figures 6, 7A, 7B:
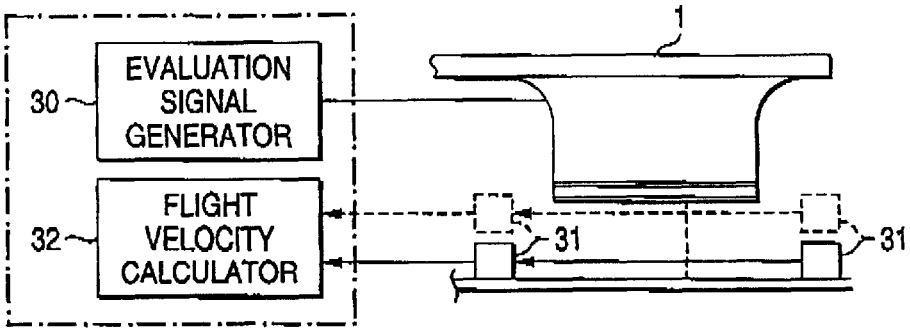
FIG. 6 is a view for describing an inspection device for measuring flight velocity of an ink droplet.
FIG. 7A is a view showing a flight velocity of an ink droplet achieved at a provisional drive voltage on a per-unit-of-nozzles basis.
FIG. 7B is a view showing a flight velocity of an ink droplet ejected from a reference nozzle row, achieved at a drive voltage.

The flight velocity is measured by use of an inspection device shown in, e.g., FIG. 6. The illustrated inspection device comprises an evaluation signal generator 30 capable of generating an evaluation signal including a small dot drive pulse DP1 shown in FIG. 5B; a laser detector 31 capable of detecting an ink droplet in the course of flying; and a flight velocity calculator 32 for calculating the flight velocity of an ink droplet in accordance with the signal detected by the laser detector 31.

In the inspection device, the evaluation signal generator 30 is configured so as to be able to generate a preset drive voltage evaluation signal. The recording head 1 is fixed at a specified height. Further, the laser detector 31 is constituted of a laser light source capable of generating a laser beam, and a light-receiving element which changes the level of an output signal upon receipt of the laser beam. The laser detector 31 is disposed such that a laser beam passes through a detection position set below the nozzle face of the recording head 1.

The flight velocity calculator 32 measures a time elapsing from when the recording head 1 has latched the small dot drive pulse DP1 included in the evaluation signal; that is, when the small dot drive pulse DP1 is supplied to the piezoelectric vibrator 2, until receipt of the detection signal output from the laser detector 31. The flight velocity of the ink droplet is determined from the thus-measured elapsed time through computation.

The ink droplet ejected from the nozzle orifice 18 cuts off a laser beam when passing through the detection position, whereupon a light-receiving element outputs a detection signal. For instance, an output signal remaining at a high level during an ordinary state (a light-receiving period) changes to a low level over a shaded period. Accordingly, the flight velocity calculator 32 can perceive a timing at which an ink droplet has passed through the detection position, in accordance with the detection signal.

Since the recording head 1 is fixed at a specified height, a distance over which an ejected ink droplet is to fly to the detection position is constant. Moreover, a lag time starting from when the small dot drive pulse DP1 is latched until when an ink droplet is ejected from the nozzle orifice 18 is also constant.

Therefore, the flight velocity calculator 32 can compute the flight velocity of an ink droplet by measuring a time elapsing from when the small dot drive pulse DP1 is latched until when an ink droplet passes through the detection position. For instance, the lag time is subtracted from the lapsed time, thereby computing the flight time of an ink droplet. The flight velocity can be computed by dividing a flight distance by the flight time.

The inspection device is not limited to a device of such a configuration, and devices of various configurations can be adopted. For instance, as indicated by dashed lines shown in FIG. 6, there may be employed a pair of laser detectors 31 whose detection positions are different from each other in a height direction. A difference between times at which the respective laser detectors 31 have output detection signals (i.e., an output time difference) is measured, and the flight velocity of the ink droplet is detected from the output time difference.

The flight velocities achieved for the respective nozzle rows 19 correspond to an average flight velocity determined by measurement of the flight velocities of ink droplets ejected from all nozzles orifices 18 in the nozzle row 19 that is an object of measurement.

FIG. 7A shows an example of flight velocities of ink droplets measured at the provisional drive voltage Vh'. In this example, the provisional drive voltage Vh' is set to 25V, and the flight velocity achieved by the first nozzle row 19A and that achieved by the seventh nozzle row 19G are 5.0 m/s. The flight velocity achieved by the second nozzle row 19B is 6.0 m/s. The flight velocity achieved by the third nozzle row 19C, that achieved by the fifth nozzle row 19E, and that achieved by the sixth nozzle row 19F are 6.4 m/s. The flight velocity achieved by the fourth nozzle row 19D is 4.0 m/s.

After the flight velocities of the ink droplets have been measured, the reference nozzle row is set (S3).

The reference nozzle row is set on the basis of a flight velocity. The nozzle row 19 that has ejected ink droplets at the lowest velocity is taken as the reference nozzle row.

With reference to the example shown in FIG. 7A, the nozzle row that has ejected ink droplets at the lowest velocity is the fourth nozzle row 19D (4.0 m/s). The remaining nozzle rows 19 have ejected ink droplets at velocities (5.0 to 6.4 m/s) higher than that achieved by the fourth nozzle row 19D. Therefore, in the case of this example, the fourth nozzle row 19D is set as the reference nozzle row.

After the reference nozzle row has been set, the drive voltage Vh is set such that the flight velocity of ink droplets ejected from the reference nozzle row achieves the required velocity or higher (S4).

Figures 8, 9:
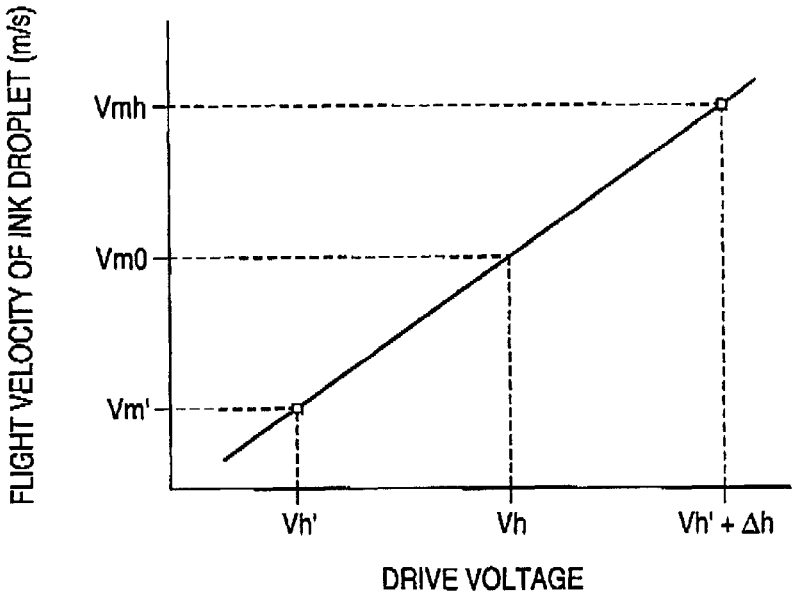
FIG. 8 is a view for describing settings on a drive voltage.
FIG. 9 is a view showing the amount of ink ejected at the drive voltage and a color adjustment ID on a per-nozzle row basis.

As shown in FIG. 8, the drive voltage Vh is set by use of, e.g., a provisional flight velocity Vm' of ink droplets achieved at the provisional drive voltage Vh' and an added flight velocity Vmh of ink droplets achieved at an added drive voltage (Vh'+Δh), which is obtained by adding an additional value Δh to the provisional drive voltage Vh'.

Specifically, a high correlation exists between the drive voltage and the flight velocities of ink droplets. A proportional relationship seemingly exists between them within a certain range. A drive voltage is set for the horizontal axis, and the flight velocity of ink droplet is set for the vertical axis. The provisional drive voltage Vh', the provisional flight velocity Vm', the added drive voltage (Vh'+Δh), and the added flight velocity Vmh are plotted on the coordinate system. A straight line is plotted so as to interconnect two points. A required velocity Vm0 is applied to the straight line (by interpolation or extrapolation), thus determining a corresponding drive voltage Vh.

The provisional flight velocity Vm' and the added flight velocity Vmh are measured through use of the same inspection device as that employed for the processing pertaining to step S2. Further, although an arbitrary value can be set for the additional value Δh, a value of, e.g., 5V, is employed.

With reference to FIG. 7B, the provisional flight velocity Vm' of ink droplets ejected from the fourth nozzle row 19D, which is the reference nozzle row, is 4.0 m/s. A drive voltage required for increasing the provisional flight velocity Vm' to the required velocity of 5.0 m/s is 30V. In this case, 30V is set for the drive voltage Vh.

If the provisional flight velocity Vm' is higher than the required velocity, the provisional voltage Vh' is set to the drive voltage Vh through processing pertaining to step S4.

The method of setting the drive voltage Vh is not limited to that set forth, and various methods can be adopted. For instance, there may be adopted a method of measuring a flight velocity Vm by increasing the provisional voltage Vh' by 0.1V, and a voltage at which the flight velocity Vm has reached the required velocity (e.g., 5.0 m/s) is adopted as a drive voltage Vh.

After the drive voltage Vh has been set, the amount of ink ejected from each of the nozzle rows 19 is then measured at the thus-set drive voltage Vh (S5).

The amount of ink is also measured through use of an electronic force balance. For instance, ink droplets are ejected only a predetermined number of times from all the nozzle orifices 18 of the nozzle rows 19 which are objects of measurement, whereby the amount of captured ink is measured. The amount of captured ink is divided by the number of times ink has been ejected and the number of nozzle orifices 18 provided in one nozzle row (e.g., 96), thereby determining the amount of ink per drop.

After the amounts of ink ejected from the nozzle rows 19 have been measured, color adjustment IDs are set (S6).

A color adjustment ID is set on the basis of the amount of offset between the amount of ink droplets ejected from each nozzle row 19 and a designed amount of ink. For example, when the amount of one droplet is 2.00 pL, the amount matches the designed value. Hence, a value of 50 is set as a color adjustment ID. If the amount of one droplet is 1.90 pL, a difference existing between that value and the designed value is −0.10 pL. An offset between the value and the designed value is −5%. Hence, a value of 45, which is lower than the standard value by 5 points, is set as a color adjustment ID. On the contrary, if the amount of one ink droplet is 2.10 pL, the value is offset from the designed value by +5%. Hence, a value of 55, which is greater than the standard value by 5 points, is set as a color adjustment ID.

In the example shown in FIG. 9, the amount of ink ejected from the first nozzle row 19A at the drive voltage (30V) is 2.00 pL, and the amount of ink ejected from the seventh nozzle row 19G at the drive voltage (30V) is also 2.00 pL. Hence, color adjustment IDs to be assigned to these nozzle rows assume a value of "50." Similarly, the amount of ink ejected from the second nozzle row 19B is 2.10 pL, and hence a color adjustment ID to be assigned to this row assumes a value of "55." The amounts of ink ejected from the third, fifth, and sixth nozzle rows 19C, 19E, and 19F are 2.14 pL, and hence color adjustment IDs to be assigned to these rows assume a value of "57." The amount of ink ejected from the fourth nozzle row 19D, which is the reference nozzle row, is 1.90 pL, and hence a color adjustment ID to be assigned to the row assumes a value of "45."

The thus-set color adjustment IDs are stored in, e.g., an identifying information storage 33 (see FIG. 10) provided in the recording head or indicated by an identifying information indicator (not shown) provided in the recording head 1.

The identifying information storage 33 is constituted of an element capable of electrically storing information (e.g., ROM). The identifying information indicator is constituted of, e.g., a seal member of a plate member, whose back is coated with an adhesive. Mark information formed from marks, such as characters, numerals, and graphics, and coded information capable of being optically read by a scanner are provided on the front face of the identifying information indicator.

Figure 10:
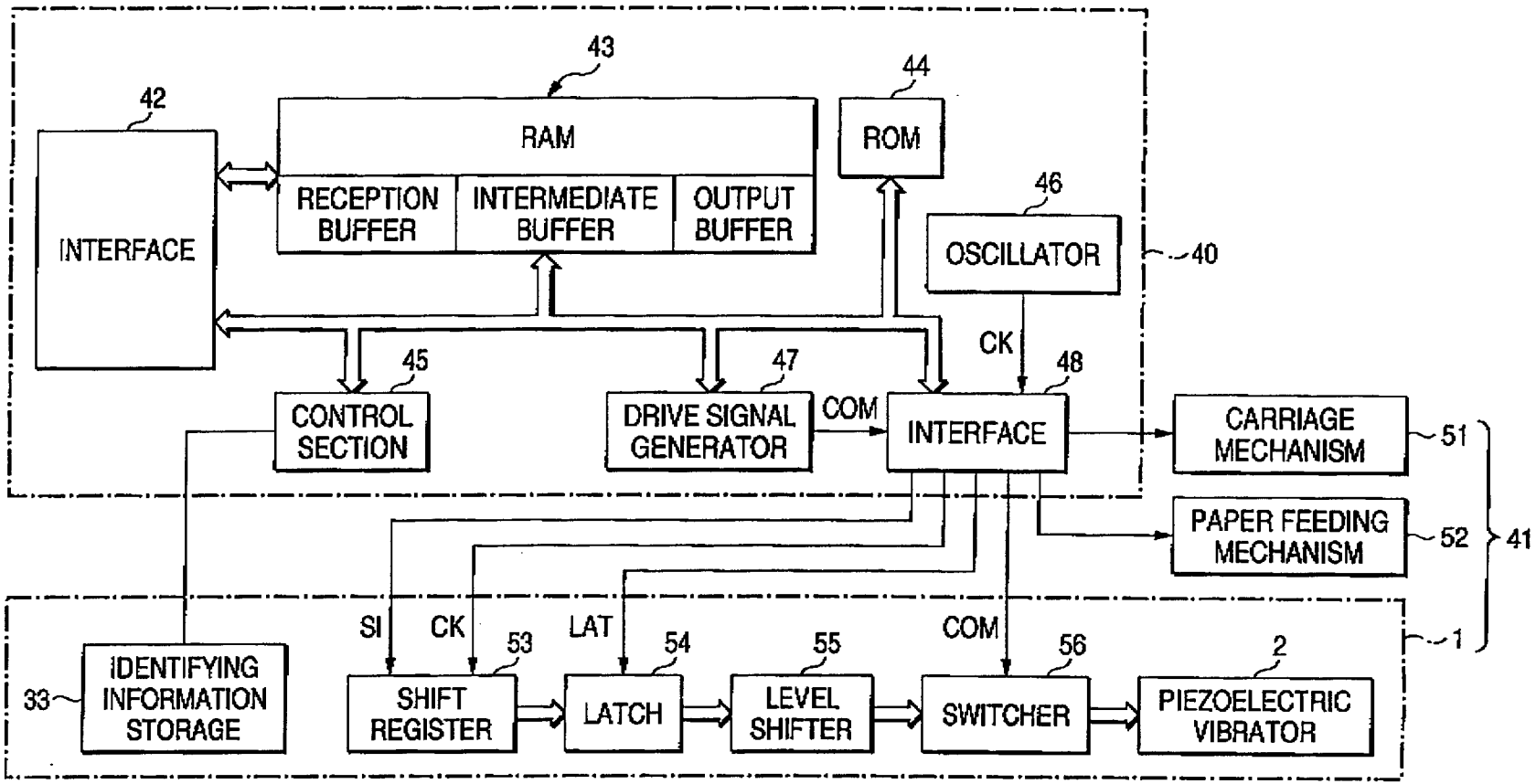
FIG. 10 is a block diagram for describing the configuration of the recording head.

Accordingly, when the identifying information storage 33 is used, various information items, such as color adjustment IDs and drive voltages Vh, can be delivered directly to a printer controller 40 (see FIG. 10). In accordance with these information items, a control operation can be performed. Moreover, the information items can also be delivered to a host computer. Hence, control can be effected by a driver installed in a host computer (not shown).

When the identifying information indicator is used, information items, such as color adjustment IDs and the drive voltage Vh, can be imparted to the printer controller 40 in accordance with mark information and coded information. Hence, a control operation is performed in accordance with the information items.

A method of use of the information items (i.e., the color adjustment IDs and the drive voltage Vh) appended to the recording head 1 will now be described. FIG. 10 is a block diagram for describing an electrical configuration of an ink jet recording apparatus, such as a printer or a plotter.

The illustrated recording apparatus is equipped with the printer controller 40 and a print engine 41. The printer controller 40 comprises an interface 42 for receiving print data or like data from the host computer; a RAM 43 for storing various types of data sets; a ROM 44 in which a control routine for processing various data sets or the like is stored; a control section 45 constituted of a CPU or the like; an oscillator 46; a drive signal generator 47 for producing a drive signal to be supplied to the recording head 1; and an interface 48 for sending to the print engine 41 print data and a drive signal, which are obtained by expansion of print data on a per-dot basis. The control section 45 also acts as an ejection controller, thereby controlling ejection of ink droplets to be performed by the recording head 1.

The print engine 41 comprises the recording head 1, a carriage mechanism 51, and a paper feeding mechanism 52. The recording head 1 comprises a shift register 53 in which print data are set; a latch 54 for latching print data set on the shift register 53; a level shifter 55 acting as a voltage amplifier; a switcher 56 for controlling supply of a drive signal to the piezoelectric vibrators 2; the piezoelectric vibrators 2; and the identifying information storage 33.

The control section 45 operates in accordance with an operation program stored in the ROM 44, thereby controlling individual sections of the recording apparatus. The drive signal generator 47 produces a drive signal COM defined having a predetermined waveform by the control section 45. As shown in, e.g., FIG. 11, the drive signal COM comprises two pairs of pulses provided in one recording cycle T, wherein each pair comprises a micro vibration pulse DP2 for finely oscillating a meniscus, and a small dot drive pulse DP1.

The micro vibration pulse DP2 assumes a trapezoidal shape. When the micro vibration pulse DP2 is supplied to the piezoelectric vibrator 2, pressure vibration which is not sufficient to induce ejection of an ink droplet develops in the pressure chamber 20, thereby finely oscillating a meniscus.

The small dot drive pulse DP1 is the same as the small dot drive pulse DP1 described in connection with FIG. 5B and set to the drive voltage Vh.

As mentioned above, the drive voltage Vh is a voltage set for increasing the flight velocity of ink droplets ejected from the reference nozzle row to a required flight velocity or higher. Even when a very small amount of ink is ejected from the reference nozzle row, the ink can be impacted on the predetermined location without fail, thereby improving image quality and preventing transformation of ink droplets.

A high correlation exists between the flight velocities of ink droplets and the amount of ink. Hence, the amount of ink can be made sufficient to fill a solid image, by setting the flight velocity of ink droplets to a required velocity or higher. Therefore, there can be prevented occurrence of a white streak, which would otherwise be caused by a deficiency in the amount of ink. Further, the ink droplets ejected from the other nozzle rows 19 have flight velocities equal to or higher than the flight velocity achieved by the reference nozzle row. Hence, precision of a landing position can be ensured, thereby preventing transformation of ink into mist.

When ink droplets are ejected in accordance with the drive signal COM of drive voltage Vh, the amount of ink ejected from the recording head 1 (i.e., an average amount of ink ejected) varies from one head to another head in accordance with a difference between the drive voltage Vh and the provisional drive voltage Vh'.

If the provisional drive voltage Vh' is 25V, an image recorded by the recording head 1 whose drive voltage Vh is set to 30V becomes more dense than the standard image. In contrast, an image recorded by the recording head 1 whose drive voltage Vh is set to 27V becomes less dense than that recorded by the recording head 1 having a drive voltage Vh of 30V but more dense than the standard image.

The amount of ink ejected from the nozzle row 19 also varies by only the amount defined by the color adjustment ID. In the case of the nozzle row 19 assigned the color adjustment ID higher than the standard value of "50," the nozzle row 19 ejects ink which is greater in amount than the designed value (e.g., 2.00 pL). In contrast, the nozzle row 19 assigned the color adjustment ID lower than the standard value ejects ink which is smaller in amount than the designed value.

In order to compensate for a difference between the amounts of ink ejected from the recording heads 1 and a difference between the amounts of ink ejected from the nozzle rows 19, the control section 45 (an image density corrector) adjusts the number of times ink droplets are to be ejected per unit area for each nozzle row 19 in accordance with the color adjustment ID assigned thereto, thereby correcting the density of an image.

For instance, in the case of a setting in which ink droplets having a total amount of 200 pL are to be impacted by ejecting an ink droplet of 2.00 pL per unit area 100 times, if a nozzle row 19 which has ejected ink in amount of 2.10 pL ejects ink droplets 95 times within a unit area, a total amount of ink impacted in the unit area becomes 199.5 pL. Thus, the resultant amount of ink is made substantially equal to 200 pL. Similarly, in the case of a nozzle row 19 which has ejected ink in amount of 1.90 pL ejects ink droplets 105 times, a total amount of ink impacted in the unit area assumes a value of 199.5 pL. Thus, the resultant amount of ink is made substantially equal to 200 pL.

For instance, in the case of the recording head 1 on which the color adjustment IDs described in connection with FIG. 9 are set, the recording head 1 performs adjustment operations shown in FIG. 12. The first nozzle row 19A and the seventh nozzle row 19G are assigned a color adjustment ID of 50, respectively. Hence, those nozzle rows eject ink equal in amount to the designed amount (i.e., 2.00 pL). Hence, the number of times ink is to be ejected from those nozzle row per unit area is set to a specified number of 100. The second nozzle row 19B assigned a color adjustment ID of 55 ejects ink in amount greater than the specified amount by 5%. Hence, the number of times ink is to be elected from this nozzle row per unit area is set to 95, which is smaller than the specified number of times by 5%. Similarly, the third, fifth, and sixth nozzle rows 19C, 19E, and 19F respectively assigned a color adjustment ID of 57 eject ink in amount greater than the specified amount by 7%. Hence, the number of times ink is to be ejected from those nozzle rows is set to 93, which is smaller than the specified number of times by 7%. In contrast, the fourth nozzle row 19D assigned a color adjustment ID of 45 ejects ink in amount smaller than the specified amount by 5%. Hence, the number of times ink is to be ejected from that nozzle row per unit area is set to 105, which is greater than the specified number of times by 5%.

As a result, even when the amount of ink ejected from the nozzle row 19 changes from one row to another, the amounts of ink impacted in unit areas on recording paper can be made uniform, thereby recording of an image of given quality. By extension, even when the recording head 1 involves an individual difference, the head can record an image of given quality.

The first embodiment employs one type of recording mode and one type of color adjustment ID. However, the invention is not limited to such a configuration. For instance, the invention can be applied to a recording apparatus capable of operating in a plurality of recording modes.

In a second embodiment of the invention, color adjustment IDs corresponding to respective recording modes are set. For instance, as shown in FIG. 13A, a printer can select one from two types of recording modes; that is, a high-speed recording mode requiring a minimum ink amount of 13 pL, and a high-resolution recording mode requiring a minimum ink amount of 2 pL. The printer is separately provided with a high-speed mode color adjustment ID and a high-resolution mode color adjustment ID.

The second embodiment is an example in which color adjustment IDs are set respectively for the high-resolution mode and the high-speed mode in accordance with the flight velocity of ink droplets. In this embodiment, a drive signal for high-resolution mode and another drive signal for high-speed mode are prepared. A plurality of types of color adjustment IDs are set by performing processing pertaining to previously-described steps S1 through S6 for each recording mode.

The control section 45 (a mode selector, and the image density corrector) selects a color adjustment ID for corresponding mode in accordance with the set recording mode, thereby adjusting the number of times ink is ejected per unit area.

Such a configuration enables use of a color adjustment ID suitable for the selected recording mode, thus improving an image quality to a greater extent.

Figures 11, 12, 13A, 13B:
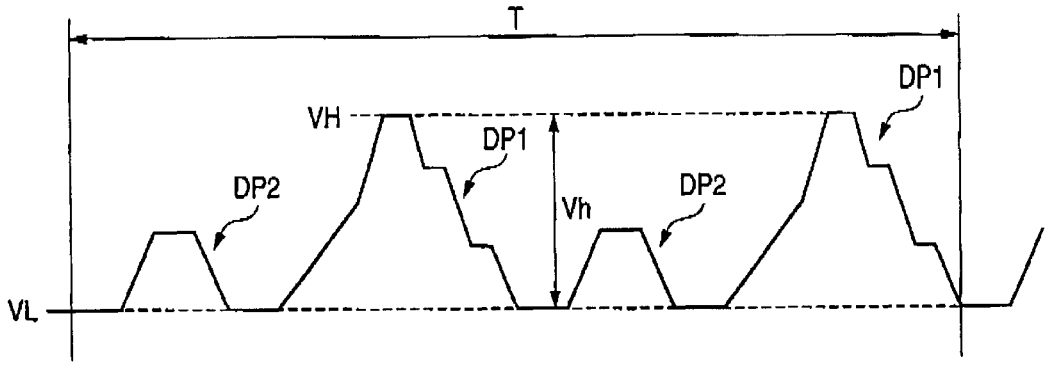
FIG. 11 is a view for describing a drive signal generated by a drive signal generator.
FIG. 12 is a view for describing control of the number of times ink is ejected per unit area.
FIGS. 13A and 13B are views for describing a case where a plurality of recording modes are available.

A third embodiment of the invention shown in FIG. 13B is directed to a case where the color adjustment IDs set during the processing pertaining to steps S1 through S6 are used for the high-resolution mode and where color adjustment IDs set in accordance with the amounts of ink droplets ejected at the provisional drive voltage Vh' are used for the high-speed recording mode.

In other words, in the embodiment, the color adjustment IDs set during the processing pertaining to the steps S1 through S6 are used in a recording mode in which the minimum amount of ink is smaller than the criterion amount of ink (e.g., 8 pL). In a recording mode in which the minimum amount of ink is greater than the criterion amount of ink, the color adjustment IDs determined for the average amount of ink ejected from the recording head 1 (e.g., 13 pL) are used.

Even in this embodiment, the control section 45 (the mode selector, the image density corrector) selects a color adjustment ID corresponding to a set recording mode, thereby adjusting the number of times ink is ejected per unit area. In other words, when a high-resolution mode is set, the number of times ink is ejected is adjusted by use of the color adjustment ID involving a minimum ink amount of 2 pL. When a high-speed mode is set, the number of times ink is ejected is adjusted by use of the color adjustment ID involving a minimum ink amount of 13 pL.

In the embodiment, the minimum amount of ink in a high-speed mode is 13 pL, and the amount is sufficient as an amount of ink to be ejected from a printer of this type. Therefore, a flight velocity higher than a required velocity is readily achieved, thereby diminishing the chance of transformation of ink into mist and variations in the amount of ink. Consequently, there is less probability that an image quality is deteriorated even when the color adjustment ID set on the basis of the average amount of ink ejected from the recording head 1 (i.e., the amount of ink ejected at the provisional drive voltage Vh').

When the color adjustment ID is determined on the basis of the amount of ink, the amount of ink can be set simply. Hence, processing pertaining to processes can be accomplished within a short period of time, thereby curtailing costs for manufacturing products.

In the embodiment having a plurality of recording modes, the recording mode is not limited to two types and may exceed three or more types.

The embodiment illustrates a drive signal having one type of drive pulse (i.e., the small dot drive pulse DP1). However, the drive signal is not limited to this; the invention can be applied to a recording head which performs a driving operation with a drive signal having a plurality of types of drive pulses which differ from each other in amount of ink ejected. In this case, for example, the foregoing adjustment method is applied to a drive pulse involving a minimum amount of ink which is susceptible to an increase in variations, thereby determining a drive voltage and color adjustment IDs.

When the recording heads 1 use drive signals of identical waveform pattern, a drive voltage can be changed; that is, the amount of ink ejected can be changed in accordance with a difference in the drive signal between the maximum potential and the minimum potential. In this case, a high correlation exists between the amount of ink ejected and a flight velocity. It turns out that the flight velocity changes in accordance with the magnitude of an increase or decrease when the amount of ink to be ejected is increased or decreased.

In a fourth embodiment of the invention, attention is paid to this point. The nozzle row which ejects the minimum amount of ink is taken as the reference nozzle row. The drive voltage of the drive signal is set such that the amount of ink ejected from the reference nozzle row becomes greater than the criterion amount of ink. Here, the term "criterion amount of ink" means the amount of ink which is defined by the required velocity and at which a flight velocity not less than the required velocity is achieved.

As a result, a required flight velocity is ensured for ink droplets ejected from the reference nozzle row. Even when an extremely small amount of ink, such as an amount of 2 pL, is to be ejected, the ink can be caused to impact on the predetermined position without fail, thereby preventing transformation of ink into mist. Further, the ink droplets ejected from the nozzle rows 19 other than the reference nozzle row become equal to or greater in amount or than those ejected from the reference nozzle row. Further, the ink droplets ejected from the nozzle rows 19 other than the reference nozzle row become equal to or higher in flight velocity than those ejected from the reference nozzle row. Therefore, the flight velocity of ink ejected from the entire recording head 1 also becomes higher than the required velocity, thereby ensuring accuracy for the landing position of ink droplets and preventing transformation of ink into mist.

However, the drive voltage is set in agreement with the reference nozzle row which ejects the minimum amount of ink. The drive voltage is determined in accordance with each of the recording heads 1. As a result, the amount of ink to be ejected (i.e., an average amount of ink) changes from one head to another head.

Such a difference in amount of ink ejected is attributable to occurrence of inconsistencies in the density of an image. For instance, when two recording heads 1 differ from each other in terms of amount of ink ejected, an image recorded by the recording head 1 which ejects a greater amount of ink becomes more dense than that recorded by the recording head 1 which ejects a smaller amount of ink. Accordingly, if an image is recorded on the basis of single print data by use of these recording heads 1, inconsistencies arise in the density of the resultant image.

Even in one recording head 1, the amount of ink ejected varies from one nozzle row to another nozzle row.

A difference in the amounts of ink ejected from nozzle rows affect the hue of an image. If a recording operation is performed while conditions of the respective nozzle rows 19 are made uniform, the color of ink ejected from the nozzle row 19 which ejects ink in amount greater than the average amount of ink of the recording head 1 becomes more dense. In contrast, the color of ink ejected from the nozzle row 19 which ejects ink in amount smaller than the average amount of ink of the recording head 1 becomes less dense. For instance, when the amount of ink ejected from the magenta nozzle row is greater than the average amount of ink ejected, a resultantly recorded image assumes a color more reddish than that of a standard image.

In order to compensate for a difference between the amounts of ink ejected from the recording heads 1 and a difference between the amounts of ink ejected from the nozzle rows 19, the recording head 1 is afforded color adjustment IDs (first identifier), each representing a relative proportion of amount of ink ejected from each nozzle row, and offset IDs (second identifier), each representing an offset from a target value; that is, an average amount of ink, stemming from actuation of nozzles at a set drive voltage.

When the recording head 1 is incorporated into the printer, the amount of ink to be ejected per unit area; that is, the number of times ink droplets are ejected, is increased or decreased by use of the color adjustment IDs and the offset IDs, thereby adjusting image density and hue (color balance) to designed image density and designed hue.

Figure 14:
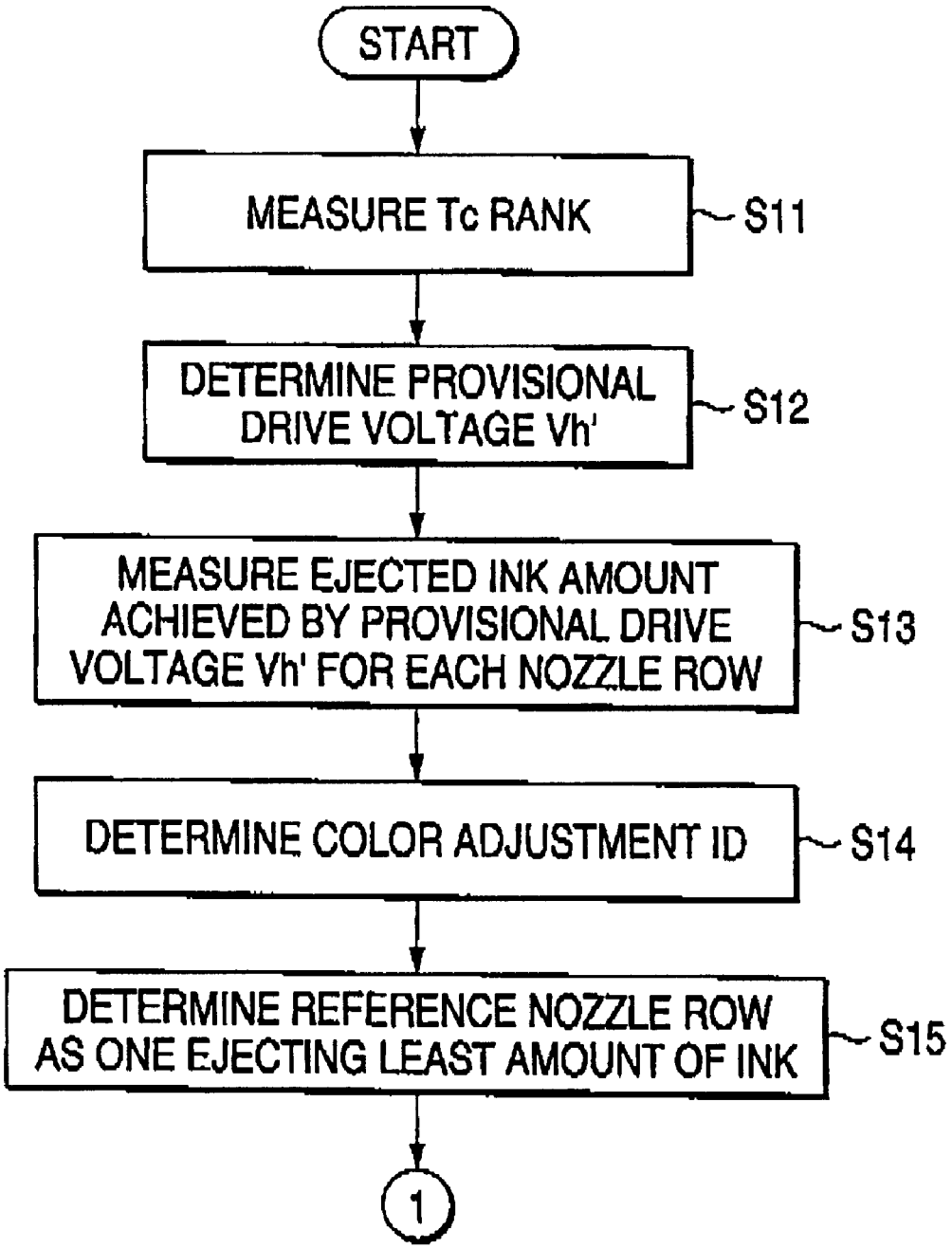
FIGS. 14 and 15 are flowcharts for describing procedures for setting of a drive voltage, a color adjustment ID, and an offset ID.
Figure 15:
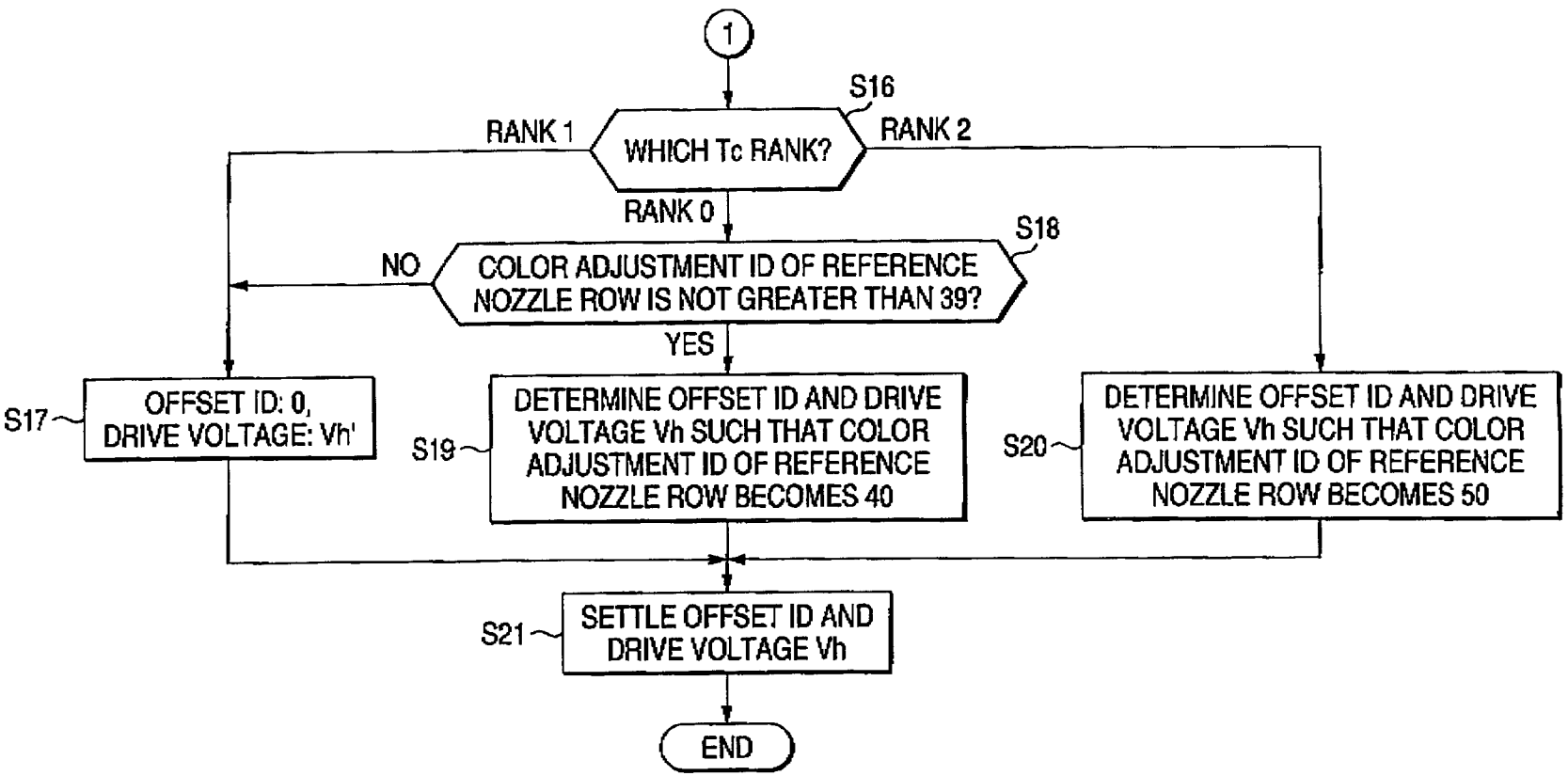

Procedures for setting a drive voltage of a drive signal, color adjustment IDs, and offset IDs will be described in detail hereinbelow by reference to a flowchart shown in FIGS. 14 and 15. The drive voltage, the color adjustment IDs, and the offset IDs are set in, e.g., a process for inspecting a recording head 1 which has finished being assembled.

At the time of setting of a voltage and IDs, a Tc rank for the recording head 1 is determined (S11). Here, the term "Tc rank" means a rank determined on the basis of a natural period Tc. In the embodiment, the natural period Tc comprises three ranks; namely, a standard rank "rank 0," a "rank 1" which is shorter than the standard rank, and a "rank 2" which is longer than the standard rank. Here, the natural period Tc is the time period of pressure vibration which travels back and forth within the ink stored in spaces (a pressure chamber in a broad sense) consisting of the pressure chamber 20 and the nozzle communication port 23.

The reason for measuring a Tc rank is that a high correlation exists between the natural period Tc and the flight velocity of ink droplets and that the flight velocity of ink droplets changes in accordance with the natural period Tc even when an equal amount of ink to be ejected is achieved. Changing of the flight velocity of ink droplets in accordance with the natural period Tc signifies that the criterion amount changes in accordance with the natural period Tc. For this reason, if the drive voltage is set in consideration of the Tc rank, there can be effected appropriate settings reflecting the characteristics of the recording head 1.

Figure 16:
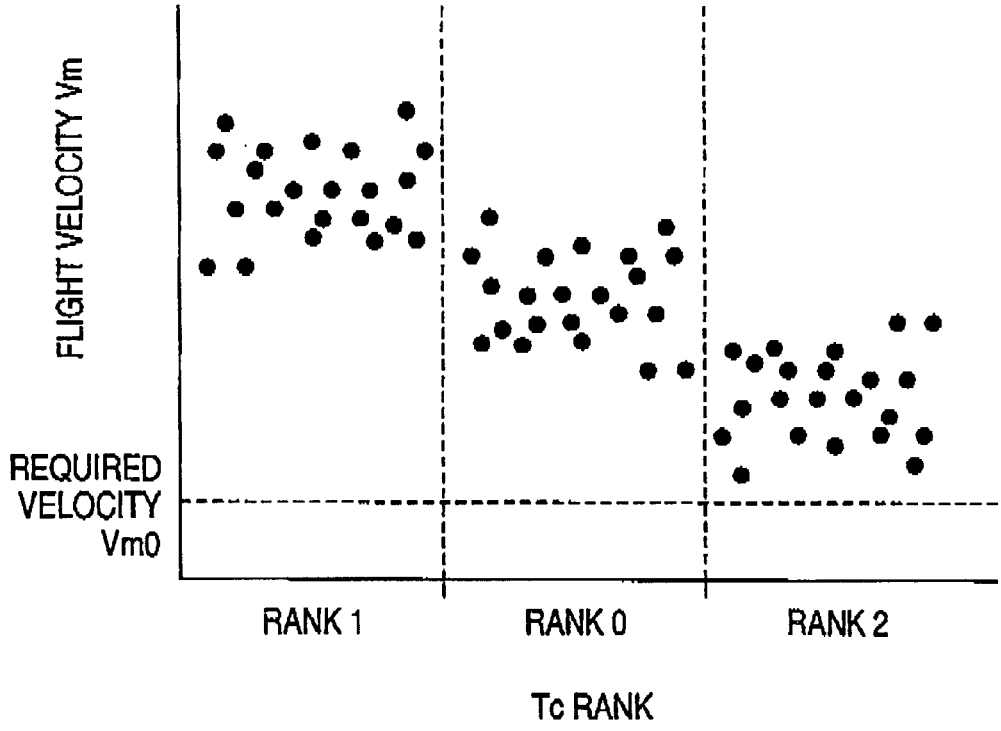
FIG. 16 is a view showing a relationship between a Tc rank and the flight velocity.

As shown in FIG. 16, for example, when the amount of ink ejected has been adjusted to a target amount (e.g., 2.0 pL), the recording head 1 is assigned a Tc rank 1; that is, the natural period Tc of the head is shorter than the standard, and achieves an average flight velocity Vm of ink droplet which is sufficiently higher than the required velocity. When the recording head 1 is assigned a Tc rank 2; that is, when the natural period of the head is longer than the standard, the recording head 1 achieves an average flight velocity Vm which is substantially equal to or faster than the required velocity. Further, when the recording head 1 is assigned a standard Tc rank 0; that is, when the natural period Tc of the head is standard, the recording head 1 achieves an average flight velocity Vm which is substantially intermediate between Tc rank 1 and Tc rank 2.

As can be seen from FIG. 16, the recording head 1 classified into the Tc rank 1 achieves an average flight velocity Vm which is sufficiently faster than the required velocity Vm0. Hence, even when the reference nozzle row has a large deviation; that is, even when the flight velocity of ink ejected from the reference nozzle row greatly varies toward a lower velocity in relation to an average flight velocity, the flight velocity Vm of ink droplets ejected from the reference nozzle row is still higher than the required velocity Vm0. Therefore, it can be seen that a sufficient flight velocity Vm can be achieved even when the recording head 1 in the Tc rank 1 is actuated at a provisional drive voltage Vh' (which will be described later) determined on the basis of the target amount of ink; in other words, there is no necessity for effecting adjustment in accordance with the criterion amount.

The recording head 1 classified into Tc rank 0 achieves an average flight velocity Vm which is slightly higher than the required velocity Vm0. However, if the reference nozzle row has a great deviation, the ink droplets ejected from the reference nozzle row may have a chance of flying at a velocity lower than the required velocity. To avoid this, the criterion amount regarding the recording head 1 assigned the Tc rank 0 is set such that, when the reference nozzle row has a great deviation, the provisional drive voltage Vh' is corrected so as to produce a drive voltage.

For example, when the criterion amount is set to a value which is smaller than the target amount of ink droplet by 10% and when the amount of ink to be ejected from the reference nozzle row is smaller than the criterion amount, the provisional drive voltage is corrected to a positive value, thereby producing a normal drive voltage Vh and causing ejection of ink which is greater in amount than the criterion amount.

The recording head 1 classified into Tc rank 2 achieves an average flight velocity Vm which is substantially equal to the required velocity Vm0. Hence, the nozzle row 19 which ejects ink at a flight velocity lower than the average flight velocity Vm may eject ink droplets at a velocity lower than the required velocity Vm0. To avoid this, the criterion amount regarding the recording head 1 assigned the Tc rank 2 is set such that the provisional drive voltage Vh' is adjusted so as to produce a drive voltage regardless of whether or not the reference nozzle row has a deviation.

For example, the criterion amount is set as the target amount of ink droplets. The provisional voltage Vh' is adjusted to a positive value such that the amount of ink to be ejected from the reference nozzle row becomes greater than the target amount, thereby producing a normal drive voltage Vh and causing all the nozzle rows 19 to eject ink which is greater in amount than the criterion amount.

Next will be described a method of measuring a Tc rank.

Figure 17:
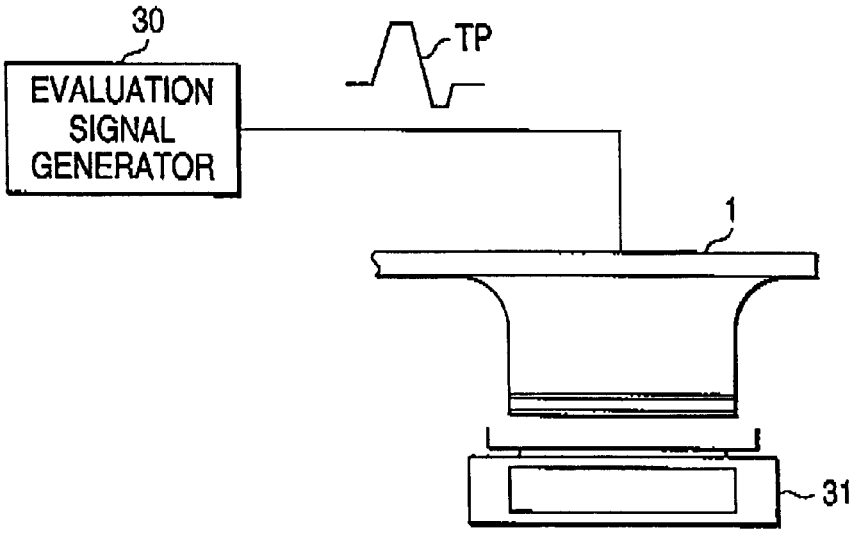
FIG. 17 is a view for describing a device for measuring the Tc rank.

As shown in FIG. 17, a Tc rank is measured by use of an evaluation signal generator 30 and an electronic force balance 31. In the embodiment, the evaluation signal generator 30 is electrically connected to the recording head 1. An evaluation pulse TP1 generated by the evaluation signal generator 30 is supplied to the piezoelectric vibrator 2, whereby the recording head 1 ejects ink droplets. The amount of thus-ejected ink is measured by use of the electronic force balance 31. A natural period Tc is determined on the basis of the thus-measured weight of ink.

Figure 18:
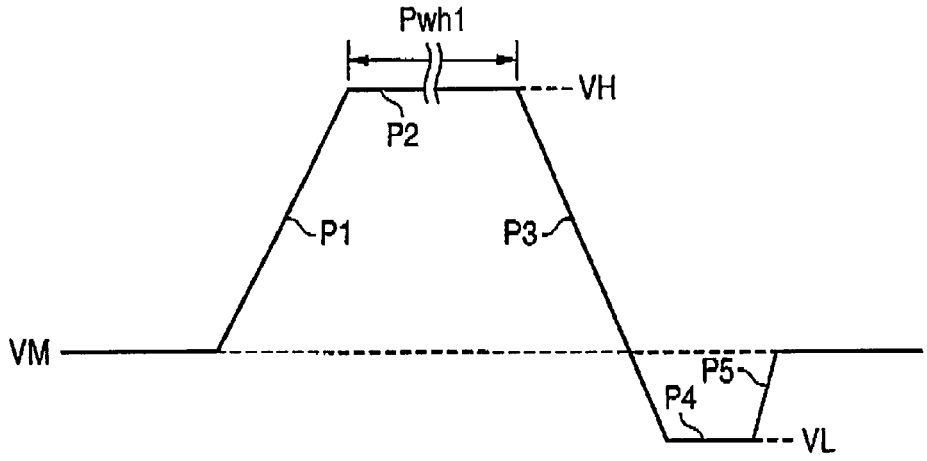
FIG. 18 is a view for describing an evaluation pulse.

For instance, the evaluation signal generator 30 produces, e.g., the evaluation pulse TP1 shown in FIG. 18. The evaluation pulse TP1 comprises an excitation element P1 for increasing a voltage from an intermediate voltage VM to a maximum voltage VH at a constant slope; a first holding element P2 which is generated so as to follow the excitation element P1 and maintains the maximum voltage VH; a discharging element P3 which is produced so as to follow the first holding element P2 and causes discharge of ink droplets from the nozzle orifices 18 by lowering the maximum potential VH to the minimum potential VL at a given slope; a second holding element P4 which is produced so as to follow the discharging element P3 and maintains the minimum potential VL; and a damping element P5 which increases an electric potential from the minimum potential VL to the intermediate potential VM at a given slope.

The first holding element P2 defines a timing at which supply of the discharging element P3 is started; in other words, a time from the end of the excitation element P1 to the beginning of the discharging element P3. At the time of measurement of weight of ink, a plurality of types of generation time periods Pwh1 (i.e., supply time periods) are set. Specifically, the weight of ink is measured a plurality of times by use of a plurality of types of evaluation pulses TP1 having different times Pwh1 for generating the first holding element P2.

In the embodiment, the weight of ink is measured three times by use of three evaluation pulses; that is, a first evaluation pulse whose generation time period Pwh1 is set to a first standard time period serving as a reference; a second evaluation pulse whose generation time period Pwh1 is set to a second standard time period shorter than the first standard time period; and a third evaluation pulse whose generation time period Pwh1 is set to a third standard time period longer than the first standard time period.

In a case where an assembled recording head 11 has a natural period Tc as designed, the first standard time period is set to a time where the amount of ink ejected is minimized. In other words, the generation time period Pwh1 is set such that a sum of the generation time period Pwh1 and the time at which the excitation element P1 is produced matches a designed value of the natural period Tc. The second standard time period is set so as to become shorter than the first standard time period by a predetermined period of time. The third standard time period is set so as to become longer than the first standard time period by a predetermined period of time.

Figures 20, 21:
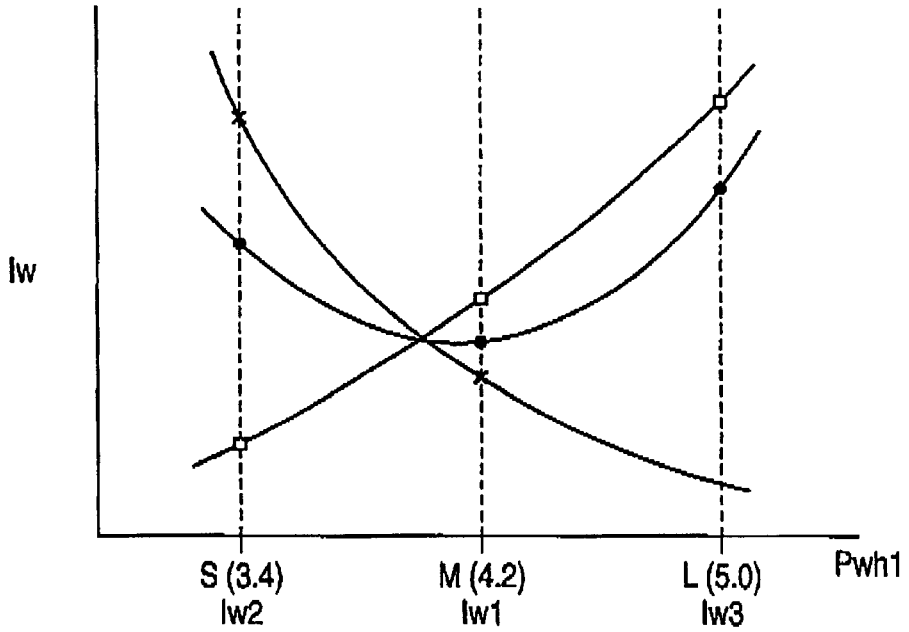
FIG. 20 is a view for describing a correlation between a time period for which a first holding element is generated and the amount of ink.
FIG. 21 is a schematic diagram for describing the relationship between a Tc rank ID and a natural period.

More specifically, in a case where the natural period Tc has a designed value of about 8.4 $\mu$s (microseconds), the first standard time period (M) of the generation time period Pwh1 assumes a value of 4.2 $\mu$s, as shown in FIG. 20. The second standard time period (S) assumes a value of 3.4 $\mu$s, which is shorter than the first standard time period by 0.8 $\mu$s. The third standard time period (L) assumes a value of 5.0 $\mu$s, which is longer than the first standard time period by 0.8 $\mu$s.

To measure the weight of ink, the three types of evaluation pulses TP1 are supplied to the piezoelectric vibrator 2. When the evaluation pulses TP1 are supplied to the piezoelectric vibrator 2, the pressure chamber 20 expands in association with supply of the excitation element P1, thereby inducing pressure vibration in the ink stored in the pressure chamber 20. Subsequently, the expanded state of the pressure chamber 20 is maintained over a supply time period Pwh1 of the first holding element P2. In association with supply of the discharging element P2, the pressure chamber 20 contracts, thereby discharging ink droplets from the nozzle orifices 18. The thus-discharged ink droplets are captured, and the amounts (weights) of the ink captured by respective evaluation pulses are measured by use of the electronic force balance.

At this time, the amount of ink ejected changes from one evaluation pulse to another evaluation pulse. For instance, in a case where the assembled recording head 1 has a natural period Tc as designed, if the first evaluation pulse is used, the discharging element P3 is supplied at a timing depicted by M in FIG. 19. In this case the pressurizing power exerted on ink by the discharging element P3 is canceled by pressure vibration of ink excited by the excitation element P1. Hence, the amount of ink ejected is minimized (i.e., is the least). Further, use of the second evaluation pulse enables supply of the discharging element P3 at a timing depicted by S in FIG. 19. When the third evaluation pulse is used, the discharging element P3 is supplied at a timing depicted by L in FIG. 19. In these cases, ink can be pressurized more efficiently than in the case where the first evaluation pulse is used, and hence the amount of ink becomes greater than that measured by use of the first evaluation pulse.

In a case where the assembled recording head 1 has a natural period Tc shorter than a designed cycle, the time period Pwh1, at which the first holding element P2 is to be supplied and the amount of ejected ink is the least, becomes shorter than that required by the recording head 1 whose natural period Tc is as designed. For this reason, the amount of ink measured by use of the second evaluation pulse becomes the least. The amount of ink determined by use of the first evaluation pulse becomes the second least. The amount of ink determined by use of the third evaluation pulse becomes the greatest.

Figure 19:
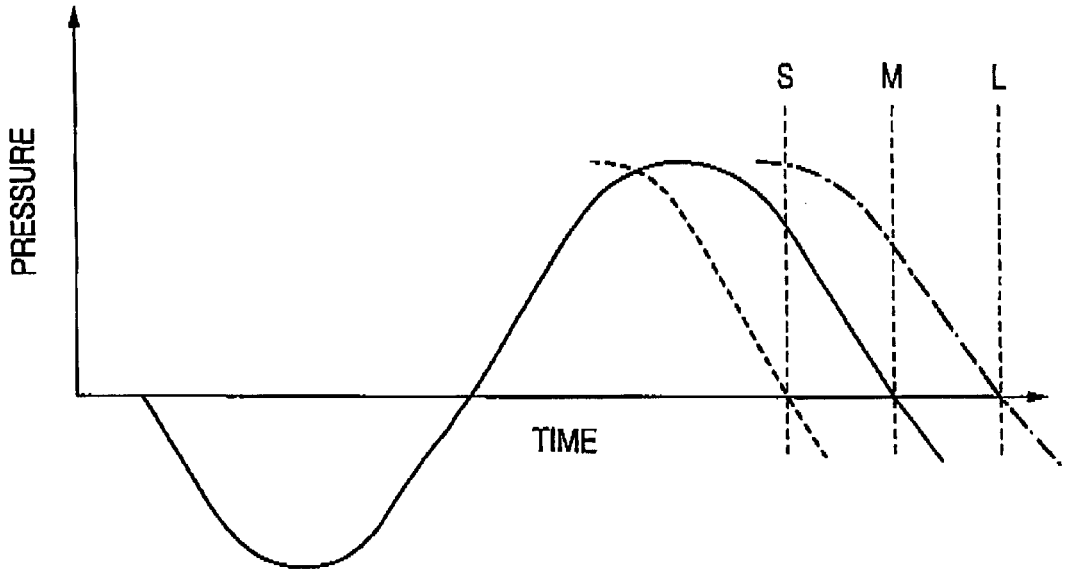
FIG. 19 is a view for describing variations in the pressure of a pressure chamber developing at the time of supply of an excitation element.

In contrast, in a case where the assembled recording head 1 has the natural period Tc longer than a designed value, as indicated by dashed lines in FIG. 19, the time period $\text{Pwh}1_1$, at which the first holding element P2 is supplied and the amount of ink ejected becomes the least, becomes longer than that achieved by the recording head 1 whose natural period Tc is as designed. Therefore, the amount of ink measured by use of the second evaluation pulse becomes the greatest, and that measured by use of the first evaluation pulse becomes the second greatest. The amount of ink measured by use of the third evaluation pulse becomes the least.

After the amounts of ink have been measured through use of the respective evaluation pulses TP, Tc ranks are set on the basis of results of measurement. As shown in FIGS. 20 and 21, a Tc rank is set by comparison between an ink weight Iw1 corresponding to the first evaluation pulse (Pwh1=4.2 $\mu$s), an ink weight Iw2 corresponding to the second evaluation pulse (Pwh1=3.4 $\mu$s), and an ink weight Iw3 corresponding to the third evaluation pulse (Pwh1=5.0 $\mu$s).

In the case of the recording head 1 (indicated by a line segment with a circular symbol shown in FIG. 20) in which a result of comparison between the ink weights Iw1, Iw2, and Iw3 shows that the ink weight Iw1 is the least and the ink weights Iw2, Iw3 are greater than the ink weight Iw1, the natural period Tc of the assembled recording head 1 is as designed. Hence, the recording head is classified into Tc rank 0. Similarly, the recording head 1 in which the ink weights Iw1 and Iw2 are substantially equal to each other and the Ink weight Iw3 is greater than the ink weight Iw1, and the recording head 1 in which the ink weights Iw1 and Iw3 are substantially equal to each other and the ink weight Iw2 is greater than the ink weight Iw1 are also classified into the Tc rank 0.

In the case of the recording head 1 (indicated by a curve with a square symbol shown in FIG. 20) in which the ink weight Iw2 is the least, the ink weight Iw1 is the second least, and the ink weight Iw3 is the greatest, the natural period Tc of the assembled recording head 1 is shorter than a designed value. Therefore, the recording head 1 is classified into Tc rank 1.

In the case of the recording head 1 (indicated by a curve with a cross symbol shown in FIG. 20) in which the ink weight Iw2 is the greatest, the ink weight Iw1 is the second greatest, and the ink weight Iw3 is the least, the natural period Tc of the assembled recording head 1 is longer than a designed value. Therefore, the recording head 1 is classified into Tc rank 2.

After the Tc ranks have been determined, the provisional drive voltage Vh' of the drive signal is set (S12).

The drive voltage of the drive signal corresponds to a potential difference between the maximum potential VH and the minimum potential VL of the small dot drive pulse DP1 shown in FIG. 5B. The provisional drive voltage Vh' is determined such that the amount of ink to be ejected as a result of supply of the small dot drive pulse DP1 to the piezoelectric vibrator 2; specifically, an average amount of ink per recording head (i.e., the weight of one ink droplet), assumes a target weight of 2.0 pL.

Figures 22, 23A, 23B:
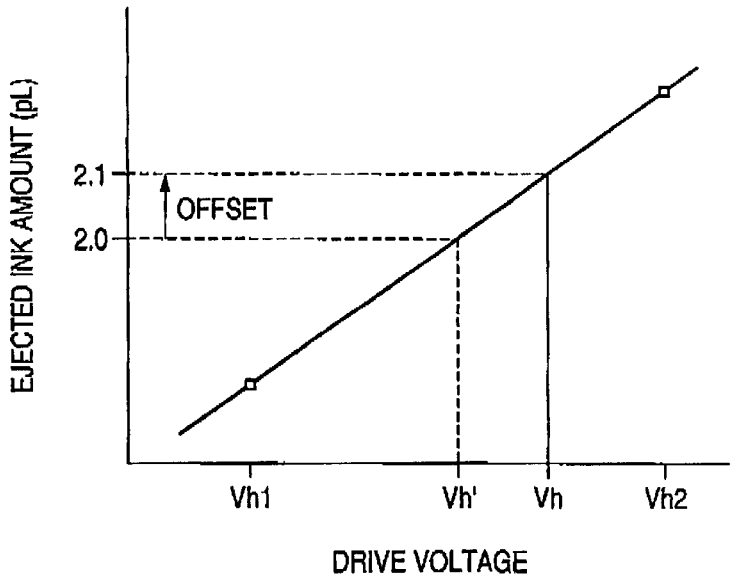
FIG. 22 is a view for describing a calibration curve to be used for determining a drive voltage.
FIGS. 23A and 23B are views for describing color adjustment IDs.

By the small dot drive pulse DP1, the amount of ink to be ejected in accordance with the drive voltage changes. Accordingly, as shown in FIG. 22, at the time of setting of a provisional drive voltage Vh', a calibration curve is prepared through use of a minimum voltage Vh1 in a range in which ink droplets are ejectable, the amount of ink corresponding to the minimum voltage Vh1, a maximum voltage Vh2 in the range, and the amount of ink corresponding to the maximum voltage Vh2. A provisional drive voltage Vh' is set through use of the calibration curve. More specifically, from the thus-prepared calibration curve, a voltage corresponding to a target value of 2.0 pL is determined. The thus-acquired voltage is taken as a provisional drive voltage Vh'.

The amount of ink ejected per recording head 1; more specifically, an average amount of ink ejected from all nozzle orifices 18, is used for the amount of ink to be used for preparing the calibration curve. The average amount of ink is calculated by measuring the amount of ink captured by use of, e.g., the electronic force balance 31, and dividing the amount of thus captured ink by the number of times ink is ejected and the total number of nozzle orifices 18.

After the provisional drive voltage Vh' has been set, the amount of ink ejected from the nozzle row 19 at the provisional drive voltage Vh' is then measured on a per-nozzle row basis (S13).

The amount of ink is also measured through use of the electronic force balance 31. For instance, ink droplets are ejected only a predetermined number of times from all the nozzle orifices 18 of the nozzle rows 19 which are objects of measurement, whereby the amount of captured ink is measured. The amount of captured ink is divided by the number of times ink has been ejected and the number of nozzle orifices 18 provided in one nozzle row (e.g., 96), thereby determining the weight of ink per droplet.

After the amounts of ink ejected from the respective nozzle rows 19 have been measured, color adjustment IDs are set (S14).

As mentioned above, the color adjustment IDs are information items showing relative proportions of amounts of ink droplet ejected from the respective nozzle rows 19 and correspond to the first identifiers of the invention. A color adjustment ID is set on the basis of the amount of ink ejected from each nozzle row 19, thereby indicating an offset from the target amount of ink. In the embodiment, a value of "50" is set as a color adjustment ID for a case where an offset from the target amount is 0%. The color adjustment ID is incremented by one each time the offset positively increases by 1%. The color adjustment ID is decremented by one each time the offset negatively decreases by 1%.

For example, the weight of one droplet is 2.0 pL, and the amount of ink droplets ejected from the nozzle row 19 for which a color adjustment ID is to be set is 2.0 pL. In such a case, no difference exists between the weight and the amount, and hence an offset assumes a value of 0%. In this case, a color adjustment ID of "50" is assigned to this nozzle row 19.

If the amount of ink ejected from the nozzle row 19 for which a color adjustment ID is to be set is 1.90 pL, a difference existing between that amount and the target value is 0.1 pL. Thus, an offset between the amount and the target value is −5%. In this case, the color adjustment ID assigned to that nozzle row 19 assumes a value of "45", which is lower than the target value of "50" by 5 points. Similarly, if the amount of ink ejected from the nozzle row 19 for which a color adjustment ID is to be set is 1.8 pL, a difference existing between that the amount and the target value is 0.2 pL (−10%). In this case, the color adjustment ID assigned to that nozzle row 19 assumes a value of "40", which is lower than the target value of "50" by 10 points.

The same also applies to cases where the amount of ink is greater than the target amount. Specifically, if the amount of ink ejected from the nozzle row 19 for which a color adjustment ID is to be set is 2.1 pL, a difference existing between that amount and the target value is 0.1 pL (+5%). In this case, the color adjustment ID assigned to that nozzle row 19 assumes a value of "55". If the amount of ink ejected from the nozzle row 19 for which a color adjustment ID is to be set is 2.2 pL, a difference existing between that amount and the target value is 0.2 pL (+10%). In this case, the color adjustment ID assigned to that nozzle row 19 assumes a value of "60".

A recording head A shown in FIG. 23A shows that the first nozzle row 19A and the fourth nozzle row 19D are respectively assigned a color adjustment ID of 45 and eject ink in an amount of 1.9 pL. Further, the head A shows that the second nozzle row 19B, the fifth nozzle row 19E, and the sixth nozzle row 19F are assigned a color adjustment ID of 50 and eject ink in an amount of 2.0 pL, which is the same as the target amount. Further, the head A shows that the third nozzle row 19C and the seventh nozzle row 19G are assigned a color adjustment ID of 55 and eject ink in an amount of 2.1 pL.

According to the setting method, an average amount of ink per recording head is used for setting the provisional drive voltage Vh'. When an average is computed from the color adjustment IDs assigned to the respective nozzle rows 19A through 19G, the average assumes a value of 50.

In a recording head B shown in FIG. 23B, the first nozzle row 19A is assigned a color adjustment ID of 35 (the weight of ink=1.7 pL); the second nozzle row 19B is assigned a color adjustment ID of 40 (the weight of ink=1.8 pL); the third nozzle row 19C is assigned a color adjustment ID of 55 (the weight of ink=2.1 pL); the fourth and seventh nozzle rows 19D and 19G are assigned a color adjustment ID of 60 (the weight of ink=2.2 pL); and the fifth and sixth nozzle rows 19E and 19F are assigned a color adjustment ID of 50 (the weight of ink=2.0 pL).

Through comparison between the recording heads A and B, the recording head B is found to having a variation between the nozzle rows 19A through 19G greater than that in the nozzle rows of the recording head A.

After the color adjustment IDs have been set, the reference nozzle row is set (S15).

The reference nozzle row is set in accordance with the amount of ink to be ejected, and the nozzle row 19 which ejects the least amount of ink is taken as a reference nozzle row. In the embodiment, the color adjustment IDs show relative proportions of the amounts of ink ejected. Hence, the nozzle row 19 assigned the least color adjustment ID is taken as a reference nozzle row.

For example, in the recording head A shown in FIG. 23A, the first nozzle row 19A and the fourth nozzle row 19D are respectively assigned a color adjustment ID of 45. Thus, these two nozzle rows 19A, 19D are assigned the least color adjustment ID. Therefore, one of the two nozzle rows 19A, 19D is taken as a reference nozzle row. Further, in the recording head B shown in FIG. 23B, the first nozzle row 19A is assigned the color adjustment ID of 35. Hence, the first nozzle row 19A is assigned the least color adjustment ID from among all the color adjustment IDs assigned to the nozzle rows 19A through 19G. Therefore, the first nozzle row 19A is set as a reference nozzle row.

After the reference nozzle row has been set, the drive voltage Vh (a voltage used for recording) and an offset ID are set (S16 through S21).

In this case, the set Tc ranks are ascertained (S16). As mentioned in connection with FIG. 16, the flight velocity of an ink droplet changes in accordance with a set Tc rank, and a criterion is changed in accordance with the Tc rank.

In a case where the recording head 1 which is an object of measurement is determined to be of Tc rank 1 in step S16, processing proceeds to step S17, where a value of 0 is set as an offset ID, and the provisional drive voltage Vh' is set, in unmodified form, as the drive voltage Vh.

The recording head 1 classified into Tc rank 1 has a sufficient margin for the required velocity Vm0 in relation to the flight velocity of ink droplets. Even when the provisional drive voltage Vh' set for the target amount of ink (2.0 pL) is used, there is less probability of the flight velocity Vm of ink droplets becoming lower than the required velocity Vm0.

When in step S16 the recording head 1 which is an object of measurement is determined to be classified into Tc rank 0, processing proceeds to step S18, thereby determining whether or not the color adjustment ID assigned to the reference nozzle row is less than 39. As mentioned above, in the case of the recording head 1 classified into Tc rank 0, if there is a nozzle row 19 whose flight velocity greatly varies toward a lower velocity, the flight velocity of the ink droplets ejected from that nozzle row 19 may be lower than the required velocity Vm0. Since a high correlation exists between the amount of ink ejected and the flight velocity of ink, a determination can be made as to whether or not a flight velocity becomes lower than the required velocity, on the basis of the color adjustment ID assigned to the reference nozzle row which eject the least amount of ink.

In the embodiment, a determination is made as to whether or not the amount of ink ejected from the reference nozzle row is smaller than the target value by 11% or more.

If the color adjustment ID assigned to the reference nozzle row assumes a value of 40 or more; that is, if an offset of −10% or less exists between the amount of ink ejected from the reference nozzle row and the target value, no nozzle row 19 is determined to have great deviations toward a lower velocity. Therefore, as in the case of the recording head classified into Tc rank 1, processing proceeds to step S17, where a value of 0 is set for an offset ID. The value of the provisional drive value Vh' is set as the drive voltage Vh in its present form.

If the color adjustment ID assigned to the reference nozzle row assumes a value of 39 or less; that is, if an offset of −11% or more exists between the amount of ink ejected from the reference nozzle row and the target value, processing proceeds to step S19. The offset ID and the drive voltage Vh are set such that the color adjustment ID assigned to the reference nozzle row assumes a value of 40. This is based on the idea that, if the color adjustment ID assumes a value of 40 or more, the flight velocity Vm of ink droplets becomes higher than the required velocity Vm0.

Accordingly, the color adjustment ID of 40 corresponds to the criterion value of the invention. This means that, if the amount of ink to be ejected from the reference nozzle row is 1.8 pL or more, the required velocity Vm0 can be ensured.

Processing pertaining to steps S18 and S19 is described by taking the recording head A shown in FIG. 23A and the recording head B shown in FIG. 23B as examples. First, in the case of the recording head A, since the color adjustment ID assigned to the reference nozzle row (e.g., the first nozzle row 19A) assumes a value of 45, the color adjustment ID is determined to not be less than 39, through processing pertaining to step S18. Further, an offset ID of 0 is set through processing pertaining to step S17, and the provisional drive voltage Vh' is taken as the drive voltage Vh in its present form.

In the case of the recording head B, since the color adjustment ID assigned to the reference nozzle row (e.g., the first nozzle row 19A) assumes a value of 35, the color adjustment ID is determined to not be less than 39, through processing pertaining to step S18. Processing proceeds to step S19. Through processing pertaining to step S19, an offset ID of 5 required for setting the color adjustment ID assigned to the reference nozzle row to a value of 40 is set as an offset ID. In other words, a value of 5 determined by subtracting the color adjustment ID of 35 assigned to the reference nozzle row from the criterion value of 40 is set as an offset ID.

The drive voltage Vh is set so as to correspond to an increment in the amount of ink indicated by the offset ID. Here, an offset ID of 5 means an increment in the amount of ink from the target value by 5%. In the embodiment, since the target value is 2.0 pL, the amount of ink is increased by only 0.1 pL, which is 5% of 2.0 pL. Accordingly, when a value of 5 is set as an offset ID, a voltage corresponding to an ink amount of 2.1 pL is set as the drive voltage Vh on the basis of a calibration curve shown in FIG. 22.

Even when an offset ID assumes a value other than 5, a drive voltage is set in the same manner. For instance, in the case of an offset ID of 10, a voltage corresponding to 2.2 pL, which is greater than the target value by 10%, is set as the drive voltage Vh. If the offset ID assumes a value of 15, a voltage corresponding to 2.3 pL, which is greater than the target value by 15%, is set as the drive voltage Vh.

When in step S16 the recording head 1 which is an object of measurement is determined to be classified into Tc rank 2, processing proceeds to step S20, where the offset ID and the drive voltage are set such that the color adjustment ID assigned to the reference nozzle row assumes a value of "50" (corresponding to the criterion value of the invention). The reason for this is that the head classified into Tc rank 2 ejects ink droplets at a flight velocity Vm close to the required velocity Vm0 and the nozzle row 19 that ejects ink droplets at a flight velocity lower than an average flight velocity ejects ink at a flight velocity lower than the required velocity with high probability.

The flight velocity of ink droplets ejected from the reference nozzle row can be increased to or beyond the required velocity by setting the amount of ink ejected from the reference nozzle row to a target value of 2.0 pL.

Processing pertaining to step S20 is described by taking the recording head A shown in FIG. 23A and the recording head B shown in FIG. 23B as examples. First, in the case of the recording head A, the color adjustment ID assigned to the reference nozzle row (e.g., the first nozzle row 19A) assumes a value of "45," the offset value of 5 required for setting the color adjustment ID to 50 is set as an offset ID. The drive voltage Vh is changed in accordance with the amount of increment (0.1 pL) in the amount of ink indicated by the offset ID. Hence, on the basis of the calibration curve shown in FIG. 22, the voltage corresponding to an ink weight of 2.1 pL is set as the drive voltage Vh.

In the case of the recording head B, since the color adjustment ID assigned to the reference nozzle row (i.e., the first nozzle row 19A) assumes a value of 35, an offset of 15 required for setting the color adjustment ID to 50 is set as an offset ID.

The drive voltage Vh is increased in accordance with the amount of increment (0.3 pL) in the amount of ink indicated by the offset ID. Hence, on the basis of the calibration curve shown in FIG. 22, the voltage corresponding to an ink weight of 2.3 pL is set as the drive voltage Vh.

The offset ID and the drive voltage, which have been set in any one of steps S17, S19, and S20, are determined in step S21.

When the recording heads A, B are classified into Tc rank 1, the color adjustment ID, the offset ID, and the drive voltage are set in accordance with settings provided in FIG. 24A. Similarly, when the recording heads A, B are classified into Tc rank 0, the color adjustment ID, the offset ID, and the drive voltage are set in accordance with settings provided in FIG. 24B. Further, when the recording heads A, B are classified into Tc rank 2, the color adjustment ID, the offset ID, and the drive voltage are set in accordance with settings provided in FIG. 24C.

According to the setting method that has been described above, the nozzle row 19 which ejects ink at the lowest flight velocity (i.e., the reference nozzle row) is determined on the basis of amount of ink ejected. Hence, determination of the reference nozzle row can be made more convenient than direct measurement of flight velocities of ink droplets. Hence, the configuration of a measurement device can be simplified. Therefore, the device is suitable for mass production. Similarly, the flight velocity of ink droplets ejected from the reference nozzle row is adjusted on the basis of the amount of ink ejected. Again, adjustment is simple.

The color adjustment IDs, the offset IDs, and the drive voltage are stored in identifying information storage 33 provided in the recording head 1 (see FIG. 10) or indicated by an identifying information indicator (not shown) provided in the recording head 1.

The identifying information storage 33 is constituted of an element capable of electrically storing information (e.g., ROM). The identifying information indicator is constituted of a seal member or a plate member, whose back is coated with an adhesive. Mark information formed from marks, such as characters, numerals, and graphics, and coded information capable of being optically read by a scanner are provided on the front face of the identifying information indicator.

Accordingly, when the identifying information storage 33 is employed, information items pertaining to the color adjustment IDs, the offset IDs, and a drive voltage can be delivered directly to the printer controller 40 (see FIG. 10). Hence, control can be performed on the basis of these information items.

When the identifying information indicator is used, information items pertaining to the color adjustment IDs, the offset IDs, and the drive voltage can be imparted to the printer controller 40 on the basis of mark information and coded information. Hence, a control operation can be performed in accordance with the information items.

There will now be described a method of using information items (e.g., color adjustment IDs, offset IDs, and a drive voltage) appended to the recording head 1. Since an ink jet recording apparatus, such as a printer or plotter, is identical in electrical configuration with that shown in FIG. 10 in connection with the first embodiment, its explanation is omitted.

When the small dot drive pulse DP1 (see FIG. 5B) whose drive voltage has been set to Vh is supplied to the piezoelectric vibrators 2, there is discharged ink which is greater in amount than target amount (i.e., 2.0 pL) by only the amount corresponding to the set offset ID. For instance, in the case of the recording head 1 assigned an offset ID of 5, an average amount of ink ejected assumes a value of 2.1 pL. In the case of the recording head 1 assigned an offset of 15, an average amount of ink ejected assumes a value of 2.3 pL.

As mentioned above, the drive voltage Vh is set for setting the amount of ink ejected from the reference nozzle row to criterion amount or more. Hence, the ink droplets are ejected from the reference nozzle row at a flight velocity not less than the required velocity. As a result, even when an extremely small amount of ink is to be ejected, the ink can be caused to impact on a predetermined location without fail, thereby improving an image quality and preventing transformation of ink into mist. Since the amount of ink ejected is greater than the criterion amount, there can be prevented occurrence of a white streak, which would otherwise be caused by a deficiency in the amount of ink. Further, the ink droplets ejected from the other nozzle rows 19 have at least the same flight velocity as that of the ink droplets ejected from the reference nozzle row. Hence, a landing position can be ensured accurately, thereby preventing transformation of ink into mist.

When ink droplets are ejected by use of a drive signal COM of drive voltage Vh, the amount of ink droplets ejected (an average amount of ink) varies from one recording head to another recording head. Further, the amounts of ink ejected from the respective nozzle rows 19 vary by only an amount specified by the color adjustment ID.

In order to compensate for a difference between the amounts of ink ejected from the recording heads 1 and a difference between the amounts of ink ejected from the nozzle rows 19, the control section 45 (image density corrector) adjusts the number of times ink droplets are to be ejected per unit area for each nozzle row 19 in accordance with the color adjustment ID assigned thereto, thereby compensating for the density of an image.

For instance, in the case of a setting in which ink droplets having a total amount of 200 pL are to be caused to impact by ejecting an ink droplet of 2.00 pL per unit area 100 times, if a nozzle row 19 which has ejected ink in amount of 2.1 pL ejects ink droplets 95 times within a unit area, a total amount of ink impacted in the unit area becomes 199.5 pL. Thus, the resultant amount of ink is made substantially equal to 200 pL. Similarly, in the case of a nozzle row 19 which has ejected ink in amount of 2.3 pL ejects ink droplets 87 times, a total amount of ink impacted in the unit area assumes a value of 200.1 pL. Thus, the resultant amount of ink is made substantially equal to 200 pL.

The control section 45 determines the number of times ink droplets are to be ejected such that the amounts of ink ejected per unit area from the respective nozzle rows 19A through 19G are made equal to the preset value.

For instance, in the case of the recording head A classified into Tc rank 0, the number of times ink is to be ejected per unit area is determined on the basis of a color adjustment ID assigned to the recording head A. In other words, as shown in FIG. 25A, the number of times ink droplets are to ejected per unit area from the first nozzle row 19A and from the fourth nozzle row 19D, both being assigned a color adjustment ID of 45, is set to 105. The number of times ink droplets are to ejected per unit area from the second nozzle row 19B, the fifth nozzle row 19E, and the sixth nozzle row 19F, all being assigned a color adjustment ID of 50, is set to 100. The number of times ink droplets are to ejected per unit area from the third nozzle row 19C and the seventh nozzle row 19G, both being assigned a color adjustment ID of 55, is set to 95.

As a result, when an image is recorded by use of the recording head 1A, there is obtained an image whose density and color balance are brought into agreement with designed density and color balance.

In the case of the recording head B classified into Tc rank 2, the number of times ink is to be ejected per unit area is determined by use of an additional value determined by adding an offset ID to a color adjustment ID. In other words, as shown in FIG. 25B, the number of times ink is to be ejected from the first nozzle row 19A given an additional value of 50 is set to 100 times; the number of times ink is to be ejected from the second nozzle row 19B given an additional value of 55 is set to 95 times; and the number of times ink is to be ejected from the fifth and sixth nozzle rows 19E, 19F given an additional value of 65 is set to 87 times. Similarly, the number of times ink is to be ejected from the third nozzle row 19C given an additional value of 70 is set to 83 times; and the number of times ink is to be ejected from the fourth nozzle row 19D given an additional value of 75 is set to 80 times.

As a result, even the recording head B can record an image whose density and color balance are brought into agreement with designed density and color balance.

The fourth embodiment has adopted one type of recording mode and one type of color adjustment ID and one type of offset ID, as well. The invention is not limited to such a configuration. For instance, the invention can also be applied to a recording apparatus capable of operating in a plurality of recording modes.

In the case of a fifth embodiment of the invention, a plurality of color adjustment IDs and offset IDs are set for each of recording modes. For instance, as shown in FIG. 26, in the case of a printer capable of selecting one from two types of recording modes; that is, a high-speed mode involving use of ink having a weight of 13 pL and a high-resolution mode involving use of ink having a weight of 2 pL, a pair comprising a high-speed color adjustment ID and an offset ID and another pair comprising a high-resolution mode color adjustment ID and an offset ID are prepared separately.

In accordance with a set recording mode, the control section 45 (mode selector and image density corrector) selects a pair comprising a corresponding color adjustment ID and a corresponding offset ID, thereby adjusting the number of times ink is to be ejected per unit area.

Such a configuration enables use of first and second identifiers suitable for the recording mode, thereby improving image quality to a much greater extent. As a matter of course, the number of types of cording modes is not limited to two but may assume three or more.

Although in the embodiment the criterion amount is set in consideration of the Tc rank IDs, the criterion amount may be set in consideration of only the amount of ink ejected.

The embodiment has illustrated a drive signal having one type of drive pulse (i.e., a small dot drive pulse DP1). However, the invention is not limited to this drive signal. The invention can be applied to a recording apparatus which performs driving operation through use of drive signals having a plurality of types of drive pulses. In this case, the foregoing adjustment method is applied to a drive pulse to be used for a minimum amount of ink which would be susceptible to greater deviations, thereby determining a drive voltage, a color adjustment ID, and an offset ID.

The invention is not limited to the embodiments set forth and is susceptible to various modifications on the basis of the appended claims.

For instance, the embodiments have illustrated the piezoelectric vibrator 2 of so-called longitudinal vibration mode as a pressure generating element. However, the invention is not limited to this type of vibrator. For instance, there may also be adopted a piezoelectric vibrator capable of vibrating in the direction of an electric field (a direction in which a piezoelectric element 10 and an internal electrode 11 are laminated). The piezoelectric element is not limited to the elements which are assembled into a unit for each of the nozzle rows 19. As in the case of a piezoelectric vibrator of so-called flexible vibration mode, a piezoelectric vibrator may be provided for each of the pressure chambers 20. Furthermore, the pressure generating element is not limited to piezoelectric vibrators. A pressure generating element may be constituted of an electromechanical transducer such as a magnetostrictive element. Alternatively, the pressure generating element may be constituted of a heating element.

What is claimed is:

1. An ink jet recording apparatus, comprising:

a recording head provided with:

a plurality of nozzles;

a plurality of pressure chambers, each communicated with one nozzle; and a plurality of pressure generating elements, each associated with one pressure chamber and actuated to eject ink from one associated nozzle;

an ejection controller, which specifies a nozzle from which an ink droplet having the least weight is ejected as a reference nozzle; and a driving signal generator, which generates a driving signal applied to the respective pressure generating elements, the drive signal having a driving voltage determined such that an ink droplet ejected from the reference nozzle has a predetermined flight velocity or more.

2. The ink jet recording apparatus as set forth in claim 1, wherein the ejection controller specifies a nozzle from which an ink droplet having the lowest flight velocity is ejected as the reference nozzle.

3. The ink jet recording apparatus as set forth in claim 1, wherein the ejection controller specifies a nozzle from which an ink droplet having the lowest amount is ejected as the reference nozzle.

4. The ink jet recording apparatus as set forth in claim 1, wherein the recording head is provided with a first identifier which indicates an ink amount ejected from each nozzle when the driving signal is applied.

5. The ink jet recording apparatus as set forth in claim 4, wherein the ejection controller includes an image density corrector which determines a number of ink ejection per a unit area of each nozzle in accordance with the first identifier.

6. The ink jet recording apparatus as set forth in claim 5, further comprising a mode selector which selects one recording mode among a plurality recording modes, each defined by an ejectable minimum amount of an ink droplet, wherein:

the recording head is provided with a plurality of first identifiers each indicating an ink amount ejected from each nozzle in an associated recording mode, when the driving signal is applied; and the image density corrector determines the ink ejection number based on a first identifier associated with a recording mode selected by the mode selector.

7. The ink jet recording apparatus as set forth in claim 6, wherein the image density corrector determines the ink ejection number only when a recording mode in which the ejectable minimum ink drop amount is less than a predetermined amount is selected by the mode selector.

8. The ink jet recording apparatus as set forth in claim 4, wherein the recording head is provided with a second identifier which indicates a difference between a target ink ejection amount and an ink amount ejected from each nozzle when the driving signal is applied.

9. The ink jet recording apparatus as set forth in claim 8, wherein the ejection controller includes an image density corrector which determines a number of ink ejection per a unit area of each nozzle in accordance with the first identifier and the second identifier.

10. The ink jet recording apparatus as set forth in claim 9, further comprising a mode selector which selects one recording mode among a plurality recording modes, each defined by an ejectable minimum amount of an ink droplet, wherein:

the recording head is provided with a plurality of first identifiers each indicating an ink amount ejected from each nozzle in an associated recording mode, when the driving signal is applied;

the recording head is provided with a plurality of second identifiers each indicating a difference between a target ink ejection amount and an ink amount ejected from each nozzle in an associated recording mode, when the driving signal is applied; and the image density corrector determines the ink ejection number based on a first identifier and a second identifier associated with a recording mode selected by the mode selector.

11. The ink jet recording apparatus as set forth in claim 1, wherein the recording head is provided with a Tc rank which is determined with reference to a natural period of ink in the pressure chamber, and referred to determine the driving voltage.

12. The ink jet recording apparatus as set forth in claim 1, wherein:

the recording head is provided with a plurality of nozzle rows;

the pressure generating elements are unitized with respect to each nozzle row.

13. The ink jet recording apparatus as set forth in claim 1, wherein the pressure generating elements are piezoelectric vibrators.

14. The ink jet recording apparatus as set forth in claim 1, wherein:

the recording head is provided with a plurality of nozzle rows each associated with one color;

the ejection controller specifies a nozzle rows from which ink droplets having the least weight are ejected as a reference nozzle rows; and the driving voltage is determined such that each ink droplet ejected from the reference nozzle row has the predetermined flight velocity.

15. A method of driving an ink jet recording apparatus, comprising the steps of:

providing a recording head provided with:

a plurality of nozzles; and a plurality of pressure generating elements, each associated with one nozzle and actuated to eject ink therefrom;

measuring weights of the respective ink droplets ejected from the recording head;

specifying a nozzle from which an ink droplet having the least weight is ejected as a reference nozzle;

generating a drive signal having a driving voltage determined such an extent that an ink droplet ejected from the reference nozzle has a predetermined flight velocity or more.

16. The driving method as set forth in claim 15, wherein the reference nozzle is specified as a nozzle from which an ink droplet having the lowest flight velocity is ejected.

17. The driving method as set forth in claim 15, wherein the reference nozzle is specified as a nozzle from which an ink droplet having the lowest amount is ejected.

18. The driving method as set forth in claim 15, further comprising the step of determining a number of ink ejection per a unit area of each nozzle in accordance with an ink amount ejected from each nozzle when the driving signal is applied.

* * * * *